US010519725B2

(12) United States Patent
Kipp et al.

(10) Patent No.: US 10,519,725 B2
(45) **Date of Patent: *Dec. 31, 2019**

(54) HYDRAULIC MULTI-DISPLACEMENT HOISTING CYLINDER SYSTEM

(71) Applicant: Ensign Drilling Inc., Calgary (CA)

(72) Inventors: Wayne D. Kipp, Leduc (CA); Ronald Pettapiece, Edmonton (CA)

(73) Assignee: Ensign Drilling Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/272,626

(22) Filed: Feb. 11, 2019

(65) Prior Publication Data

US 2019/0178041 A1 Jun. 13, 2019

Related U.S. Application Data

(63) Continuation of application No. 15/116,067, filed as application No. PCT/CA2015/050084 on Feb. 5, 2015, now Pat. No. 10,246,951.

(Continued)

(51) Int. Cl.
*E21B 19/086* (2006.01)
*F15B 11/036* (2006.01)

(Continued)

(52) U.S. Cl.
CPC ..... *E21B 19/086* (2013.01); *F15B 11/036* (2013.01); *F15B 11/04* (2013.01);

(Continued)

(58) Field of Classification Search
CPC ..... E21B 19/086
See application file for complete search history.

(56) References Cited

U.S. PATENT DOCUMENTS 2,179,557 A 11/1939 Conley
2,502,895 A 4/1950 Shaffer (Continued)

FOREIGN PATENT DOCUMENTS

EP 1843048 10/2007
JP 58113611 7/1983

(Continued)

OTHER PUBLICATIONS

Australian Examination Report No. 1 for Australian patent application 2015213448 dated Mar. 9, 2018.

(Continued)

*Primary Examiner* — D. Andrews
(74) *Attorney, Agent, or Firm* — Stradley Ronon Stevens & Young, LLP

(57) ABSTRACT

An assembly for hoisting and lowering a drill string of a drilling rig includes a multiple displacement hydraulic cylinder having a blind end, a rod end, and a single piston rod configured for slidable extension and retraction movement within the interior space of the cylinder. The interior space is defined by three chambers, each chamber having a port allowing switchable flow of hydraulic fluid into and out from the cylinder. The assembly also includes a pumping and switching system with hydraulic fluid connections to each port of the cylinder. The pumping and switching system is configured to switch the direction of hydraulic fluid flow through each of the ports of the three chambers, thereby providing the assembly with a plurality of hydraulic fluid flow path combinations. Each flow path combination provides a different speed-to-force ratio for extending or retracting the piston rod, thereby hoisting or lowering the drill string.

22 Claims, 13 Drawing Sheets

Related U.S. Application Data

(60) Provisional application No. 61/936,534, filed on Feb. 6, 2014.

(51) Int. Cl.
*F15B 11/04* (2006.01)
*F15B 11/16* (2006.01)
*F15B 15/14* (2006.01)

(52) U.S. Cl.
CPC ..... *F15B 11/16* (2013.01); *F15B 15/1447* (2013.01); *F15B 15/1466* (2013.01); *F15B 2211/20538* (2013.01); *F15B 2211/20546* (2013.01); *F15B 2211/20576* (2013.01)

(56) References Cited

U.S. PATENT DOCUMENTS

| | | | |
|---|---|---|---|
| 3,696,712 | A | 10/1972 | Sung |
| 3,904,416 | A | 9/1975 | Onoda et al. |
| 4,011,724 | A | 3/1977 | Landes et al. |
| 4,833,971 | A | 5/1989 | Kubic |
| 4,955,282 | A | 9/1990 | Ranson |
| 5,090,296 | A | 2/1992 | Todd |
| 5,186,095 | A | 2/1993 | Todd |
| 5,191,828 | A | 3/1993 | McCreery |
| 6,029,559 | A | 2/2000 | Barthalow |
| 6,145,307 | A | 11/2000 | Dantigraber |
| 6,293,359 | B1 | 9/2001 | Dobran |
| 6,890,406 | B2 | 5/2005 | Aho |
| 6,895,854 | B1 | 5/2005 | Plattner |
| 10,246,951 | B2 * | 4/2019 | Kipp ..... E21B 19/086 |
| 2005/0066655 | A1 | 3/2005 | Aarestad et al. |
| 2006/0169132 | A1 | 8/2006 | Tucker |
| 2008/0149395 | A1 | 6/2008 | Fossbakken |
| 2012/0279726 | A1 | 11/2012 | Taskinen et al. |
| 2013/0312599 | A1 | 11/2013 | Cover |

FOREIGN PATENT DOCUMENTS

| | | |
|---|---|---|
| WO | 2009002189 | 12/2008 |
| WO | 2015117240 | 8/2015 |

OTHER PUBLICATIONS

Written Opinion of the International Search Authority dated May 1, 2015, issued on International Application No. PCT/CA2015/050084 in the name of Ensign Drilling Partnership.

* cited by examiner

HYDRAULIC MULTI-DISPLACEMENT HOISTING CYLINDER SYSTEM

FIELD OF THE INVENTION

The invention is in the field of drilling rigs and more specifically relates to power systems for hoisting and lowering a drill string of a drilling rig.

BACKGROUND OF THE INVENTION

Drilling rigs are complex installations that include the equipment needed to drill various types of wells such as water wells, oil wells, or natural gas extraction wells. As is well known, drilling rigs can be mobile or more permanent land or marine-based structures that incorporate many different pieces of equipment. Generally, modern land-based drilling rigs are smaller and more mobile in order to address the increasing need for frequent relocation to new drilling sites.

In the oil and gas industry, drilling rigs have various speed and power requirements for different stages of the drilling process namely during downhole movement when a drill string is being lowered or pushed to the drilling face, during drilling itself and during tripping when the drill string is being lifted to surface.

The equipment used on the drilling rig for raising and lowering a drill string and for conducting drilling has evolved over the years. A conventional "draw-works" is the primary machinery used to hoist and to lower the drill string of a drilling rig. The main function of a draw-works is to provide a means of raising and lowering the traveling blocks of the drilling rig. A conventional draw-works consists of five main parts: the drum, the motor(s), the reduction gear, the brake, and the auxiliary brake. The motors can be AC or DC-motors, or the draw-works may be connected directly to diesel engines using metal chain-like belts. This arrangement can provide a number of gears for hoisting and lowering a drill string, which can be selected according to the various power requirements of different stages of operation of a drilling rig.

The equipment costs, fuel costs and relatively large physical footprints of conventional draw-works and various operational limitations have provided the incentive to re-engineer conventional drilling rigs. This effort is of particular importance for small mobile drilling rigs where the need to reduce the physical footprint of a rig is required to enable access and/or operation at particular sites.

Stage III rigs use hydraulic cylinder hoisting systems to raise and lower the drill string. While such systems are generally more compact and, hence mobile, they are generally not as versatile for deep drilling because of the increased hook-loads associated with deep drilling. That is, as well depth increases, the power requirements of hydraulic cylinder hoisting systems increases significantly from the need for more pumps, larger hydraulic fluid reservoirs and additional costly modifications to related equipment.

As is well known, a hydraulic cylinder is a mechanical actuator that is used to give a unidirectional force through a unidirectional stroke. Hydraulic cylinders have many applications, notably in construction equipment (engineering vehicles), manufacturing machinery, and civil engineering. Such hydraulic cylinders typically provide an enclosure having a piston and piston rod slidably disposed within the enclosure, wherein the piston rod extends outwardly from the cylinder. Pneumatic or hydraulic passageways are provided at each end of the cylinder, whereby pressurized fluid is supplied or exhausted on either side of the piston, thereby forcing the piston and piston rod to move from one end of the cylinder to the other. The piston and the piston rod move simultaneously to provide linear actuator movement to an object. Through such movement, an actuation force is imparted on the object as the piston rod moves between an extended position, wherein the piston rod extends outward from the cylinder, and a retracted position, wherein the piston is drawn into the cylinder.

It is often desirable, however, to have variable actuation forces applied to the object as the piston rod moves between the first position and the second position. Previous designs have attempted to vary the actuation forces applied to the object by manipulating the pressure levels within the power cylinder.

For example, U.S. Pat. No. 3,969,712 to Sung describes a three section telescopic cylinder ram for use in applications such as operation of multi-section telescopic crane booms. The ram has the ability to have its mid-section and interior or rod section independently actuated. The mid-section and rod section of the ram may be extended or retracted as a unit relative to the exterior base section, or the mid-section and rod section may move relative to each other in either direction while moving relative to the base section.

US Patent Application No. 2006/0169132 to Tucker describes a linear hydraulic actuator of the kind that includes a hydraulic piston and cylinder arrangement, the piston of which can be moved in extend and retract directions relative to the cylinder by application of hydraulic fluid under pressure to the piston within the cylinder. An exemplary application is in actuation of a thrust reverser system in an aircraft gas turbine engine where the cowl or other movable component is moved between deployed and stowed positions by a linear hydraulic actuator.

U.S. Pat. No. 6,895,854 to Plattner describes a power cylinder apparatus for supplying varying actuation forces to a workpiece through the supply of a constant fluid pressure. This reference teaches that different actuation forces are imparted on the workpiece as a result of fluid pressure on different surface areas of components of the cylinder.

U.S. Pat. No. 4,011,724 to Landes et al. describes an actuator for selectively and sequentially providing dual pressure forces for positioning and seating fasteners and for other purposes. The actuator is caused to be extended a first distance at low force and then to be extended an additional distance at a relatively higher force. Air pressure is selectively applied to cause all pistons and the actuating rod to retract to their initial positions.

U.S. Pat. No. 3,904,416 to Onoda et al. describes a multistage cylinder comprising at least a first-stage cylinder and a second-stage cylinder provided essentially in the piston rod of the first-stage cylinder. The first-stage and second-stage cylinders are capable of operating separately and independently of each other and are also capable of operating in opposite directions. Application of the device to industrial robots is described.

U.S. Pat. No. 5,186,095 to Todd describes a piston assembly comprising a piston cylinder including a velocity tube which extends through the piston head. Hydraulic controls are connected to the cylinder and to hydraulic lines for operating purposes. In use, fluid under pressure is directed into the velocity tube which communicates with the hollow piston rod conduit, forcing the piston along its downward stroke while prefilling the piston well with fluid. Once the work load is met, additional power is supplied to the piston as fluid is pumped into the cylinder above the piston head to apply additional hydraulic pressure for the force necessary for the work load encountered. These dual power stages cause the piston assembly to function efficiently since only a small amount of power or force is required to drive the piston during its initial stage, to bring it into contact with the work load. Thereafter, the second stage or hydraulic force provides the additional power needed to perform the work on the particular load.

U.S. Pat. No. 4,955,282 to Ranson describes a multi-chamberal hydraulic cylinder and valve system which utilizes a single relatively low flow rate pump to provide pressurized fluid during travel, compression and retraction of the piston rod. In the system, the pressurized fluid flow rate is uniform throughout the cycle of operation of a hydraulic ram which can be extended over a large low force stroke.

U.S. Pat. No. 6,890,406 to Aho describes a three-chamber cylinder that uses two rod end chambers and a large middle blind chamber. The two rods are moved simultaneously in and out from the middle blind chamber. The rods are moved at a set rate to tighten or slack off of the roll mantle, the pressures in the three chambers are kept at a constant to hold the system in a set position. The three chambers in the multi-displacement cylinder are used to push a single rod at varying speeds and pushing capabilities by varying the flow of oil to each of the three chambers. This allows the cylinder to handle large loads at slower speeds. The speed can be increased with a concomitant lowering of the load handling capacity of the cylinder.

U.S. Pat. No. 5,191,828 to McCreery describes a telescopic cylinder that is guided along a larger piston sleeve throughout the stroke of the entire cylinder. The cylinder sections telescopically extend through the more rigid tubular section allowing for larger loads to be moved. The cylinder can hoist larger loads a set distance without using a telescopic cylinder to meet the hoisting distance needs.

U.S. Pat. No. 6,029,559 to Barthalow and Zimmerman describes a system of multiple telescopic cylinders that can be controlled independently to raise and lower different sections of a boom. The cylinder system described uses multiple cylinders to extend and retract different sections of a telescoping system; the system allows for the control of each telescopic section independently of the others.

U.S. Pat. No. 6,293,359 to Dobran et al. describes a drilling apparatus that uses a cylinder to push down on a drill bit for drilling holes for blast hole drilling. The cylinder is used to move the drill bit to a rock face. A feed force is applied to the drill bit at the rock face and a reducing feed force is used to withdraw the drill bit from the hole. The cylinder has two sides to force the cylinder to move up and down due to differential pressure between the pull down and hold back sides of the cylinder.

U.S. Pat. No. 2,502,895 to Shaffer describes a hydraulic hoisting system for a drilling rig. The system includes three cylinders, two of which are configured with piston rods (connected to a cross head which supports the central third cylinder). The piston rod of the third cylinder has a hook attached thereto, for making a connection to a drill string. Switching of pressurized hydraulic fluid to direct it into various hydraulic lines can induce raising or lowering of the cross head independently of the central cylinder.

SUMMARY OF THE INVENTION

Rationale

The present inventors have recognized that expanding the range of drilling operations for class III drilling rigs could lead to increased use of these rigs, for example, in drilling operations involving heavier hook-loads and increased drilling depths. The present inventors have therefore recognized that existing drill string hoisting systems that employ basic hydraulic cylinders are not amenable to such expanded operations. Attempts to address these shortcomings have resulted in addition of more hydraulic pumps, larger hydraulic lines, more hydraulic fluid storage tanks, and higher costs. These additions also increase the weight and physical footprint of a drilling rig and tend to negate the advantages provided by hydraulic hoisting technologies. In considering this relatively new problem, the inventors have made the surprising discovery that a virtual gearing system could be developed for a drill string hoisting assembly based upon a multiple-displacement cylinder in combination with a port switching system.

It has therefore been recognized by the present inventors that the use of hydraulic cylinders for hoisting and lowering a drill string of a drilling rig may be greatly improved because current use of such hydraulic cylinders do not provide the means to provide variable speed and power. The process of raising a drill string, in tripping operations for example, has a requirement for low speed and high power for the heaviest hook-loads. However, at other stages of tripping when hook-loads are lower, low speed and high power are not needed and are in fact detriments. It is then preferable to provide high speed at lower power to quickly raise drill strings. Although such speed/power alterations may be provided to drilling rigs by conventional mechanical draw-works, it has not heretofore been recognized that a hoisting system using a multi-displacement hydraulic cylinder as the principal means for raising and lowering a drill string could also provide variable speed/power settings in a manner analogous to gears.

Overview

In accordance with the invention, there is provided an assembly for hoisting and lowering a drill string of a drilling rig, the assembly comprising: a) a multiple displacement hydraulic cylinder having a blind end, a rod end, and a single piston rod configured for slidable extension and retraction movement within the interior space of the cylinder, wherein the interior space is defined by three chambers, each chamber having a port allowing switchable flow of hydraulic fluid into and out from the cylinder; and b) a pumping and switching system with hydraulic fluid connections to each port of the cylinder, the system configured to switch the direction of hydraulic fluid flow through each of the ports of the three chambers, thereby providing the assembly with a plurality of hydraulic fluid flow path combinations, wherein each combination provides a different speed-to-force ratio for extending or retracting the piston rod, thereby hoisting or lowering the drill string.

In certain embodiments, the piston rod is hollow, a central tube is fixed to the blind end wall of the cylinder within the interior of the hollow piston rod, and the three chambers of the cylinder include: (i) a blind end chamber with boundaries defined by a portion of an interior blind end wall of the cylinder; a blind end face of the piston: an interior sidewall of the cylinder and an outer diameter sidewall of the central tube; (ii) a rod end chamber with boundaries defined by a rod end side of the piston; an interior sidewall of the cylinder; an outer sidewall of the central tube, and a rod end wall of the cylinder; and (iii) a central tube chamber with boundaries defined by a portion of the blind end wall of the cylinder and the sidewall of the central tube.

In certain embodiments, the port of the blind end chamber is in the sidewall of the cylinder adjacent the blind end, the port of the rod end chamber is in the sidewall of the cylinder adjacent the rod end, and the port of the central tube chamber is in the blind end wall of the cylinder.

In certain embodiments, the pumping and switching system comprises a means for connecting a hydraulic fluid conduit from each of the ports to a primary pump or to a hydraulic fluid reservoir.

In certain embodiments, the pumping and switching system comprises a means for connecting a hydraulic fluid conduit between the port of the blind end chamber and the port of the rod end chamber.

In certain embodiments, the pumping and switching system comprises a means for connecting a hydraulic fluid conduit between the port of the central tube chamber and the port of the rod end chamber.

In certain embodiments, the pumping and switching system comprises a transmission manifold with switchable hydraulic fluid connections to the port of the blind end chamber, the port of the rod end chamber and the port of the central tube chamber.

In certain embodiments, the transmission manifold is controlled using a manual controller or is under automatic control by a programmable processor.

In certain embodiments, the pumping and switching system comprises a blind end load-holding manifold operably connected to a hydraulic fluid conduit connecting the transmission manifold with the port of the blind end chamber.

In certain embodiments, the pumping and switching system comprises a central tube load-holding manifold operably connected to a hydraulic fluid conduit connecting the transmission manifold with the port of the central tube chamber.

In certain embodiments, the pumping and switching system comprises a secondary pump operably connected to the port of the central tube chamber for providing a secondary source of hydraulic fluid to the central tube chamber to prevent formation of a vacuum when the piston rod is extending in hydraulic fluid flow path combinations which do not include pumping of primary hydraulic fluid from the primary pump into the central tube chamber.

In certain embodiments, the plurality of hydraulic fluid flow path combinations comprises a hoisting combination wherein: a) hydraulic fluid flows from the primary pump into the port of the blind end chamber and into the port of the central tube chamber: and b) hydraulic fluid flows from the port of the rod end chamber to the reservoir.

In certain embodiments, the plurality of hydraulic fluid flow path combinations comprises a hoisting combination wherein: a) hydraulic fluid flows from the primary pump into the port of the blind end chamber without hydraulic fluid flowing into the port of the central tube chamber; and b) hydraulic fluid flows from the port of the rod end chamber to the reservoir.

In certain embodiments, the plurality of hydraulic fluid flow path combinations comprises a hoisting combination wherein: a) hydraulic fluid flows from the primary pump into the port of the blind end chamber and into the port of the central tube chamber; and b) hydraulic fluid flows from the port of the rod end chamber to the port of the blind end chamber.

In certain embodiments, the plurality of hydraulic fluid flow path combinations comprises a hoisting combination wherein: a) hydraulic fluid flows from the primary pump into the port of the blind end chamber without hydraulic fluid flowing into the port of the central tube chamber; and b) hydraulic fluid flows from the port of the rod end chamber to the port of the blind end chamber.

In certain embodiments, the plurality of hydraulic fluid flow path combinations comprises a hoisting combination wherein: a) hydraulic fluid flows from the primary pump into the port of the central tube chamber without hydraulic fluid flowing into the port of the blind end chamber; and b) hydraulic fluid flows from the port of the rod end chamber to the reservoir.

In certain embodiments, the plurality of hydraulic fluid flow path combinations comprises a lowering combination wherein: a) hydraulic fluid flows from the primary pump into the port of the rod end chamber; b) hydraulic fluid flows from the port of the blind end chamber to the reservoir; and c) hydraulic fluid flows from the port of the central tube chamber to the reservoir.

In certain embodiments, the plurality of hydraulic fluid flow path combinations comprises a lowering combination wherein: a) hydraulic fluid flows from the primary pump into the port of the rod end chamber; b) hydraulic fluid flows from the port of the blind end chamber to the reservoir; and c) hydraulic fluid flows from the port of the central tube chamber to the port of the rod end chamber.

In certain embodiments, the plurality of hydraulic fluid flow path combinations comprises a lowering combination wherein: a) hydraulic fluid flows induced by the force of gravity from the port of the central tube chamber to the reservoir; and b) hydraulic fluid flows from the port of the blind end chamber to the port of the rod end chamber.

Another aspect of the present invention is a drilling rig with an assembly for hoisting and lowering a drill string supported by a floating crown on the drilling rig, the assembly comprising: two multiple displacement hydraulic cylinders as described herein disposed between the floor of the rig and the floating crown; and a pumping and switching system as described herein, wherein the pumping and switching system has connections to the ports of each of the two cylinders for providing simultaneous extension or retraction of the piston rod of each of the two cylinders, thereby hoisting or lowering the drill string.

Another aspect of the present invention is a method for hoisting or lowering a drill string of a drilling rig, the method comprising the steps of a) providing the drilling rig with an operative assembly as described herein; b) identifying a set of parameters for the hoisting or lowering of the drill string; and c) selecting a combination of hydraulic fluid flow paths for extending or retracting the piston rod, thereby providing a speed-to-force ratio for hoisting or lowering the drill string which is matched to the set of parameters.

In certain embodiments, the set of parameters includes the desired speed of hoisting or lowering of the drill string and the weight of the drill string.

In certain embodiments, steps b) and c) are repeated during different stages of an operation that includes hoisting or lowering of the drill string.

BRIEF DESCRIPTION OF THE DRAWINGS

The invention is described with reference to the accompanying figures in which.

Figure 3:
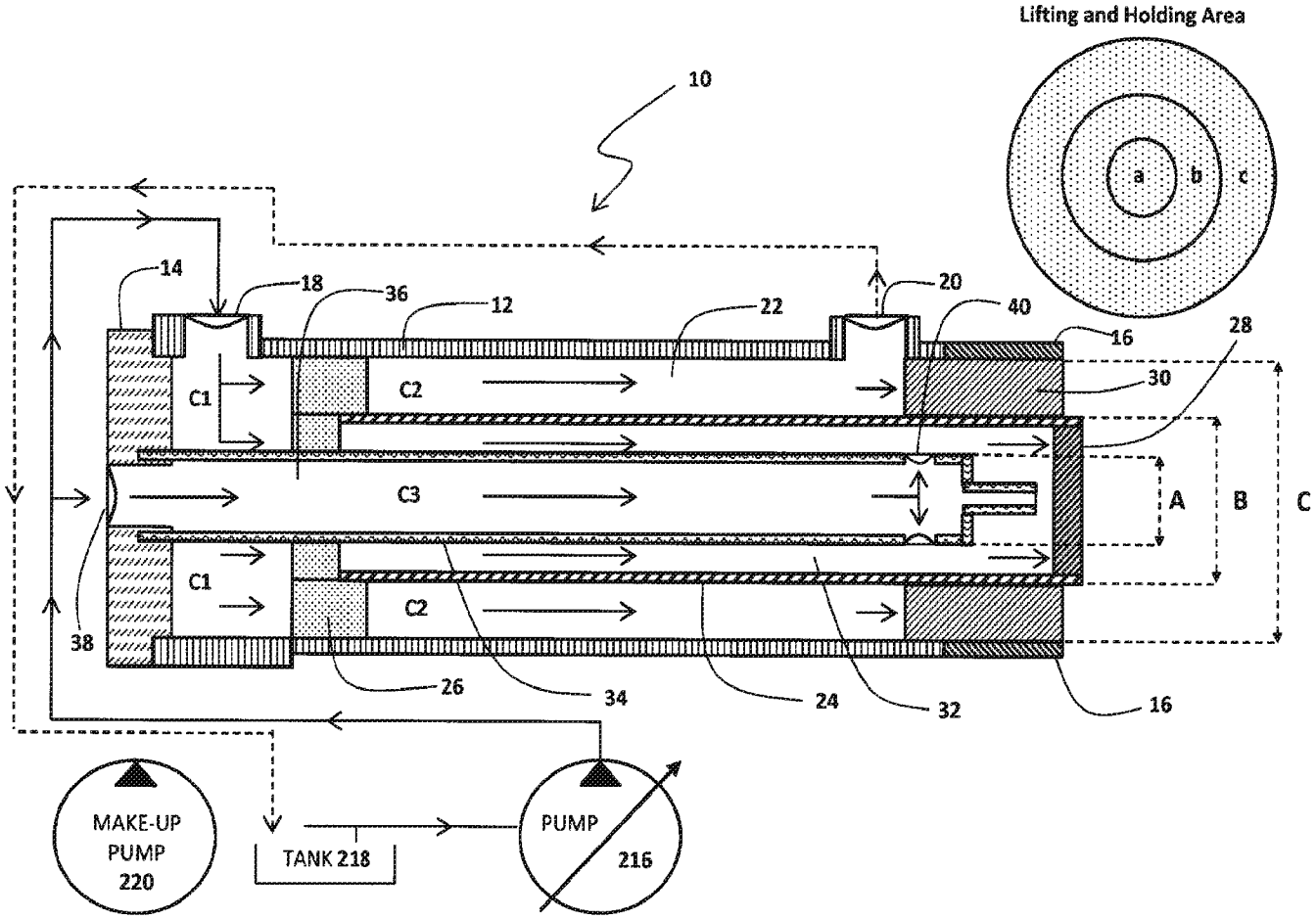

FIG. 3 is a schematic representation of one embodiment of an MDHC 10 shown in the retracted position with arrows indicating hydraulic fluid flow through the chambers C1, C2 and C3 for the virtual hoisting gear designated herein as "Hoist 1." The solid arrows indicate fluid movement under direct hydraulic pressure and the dashed arrows indicate the movement of fluid displaced from the MDHC 10.

Figure 4:
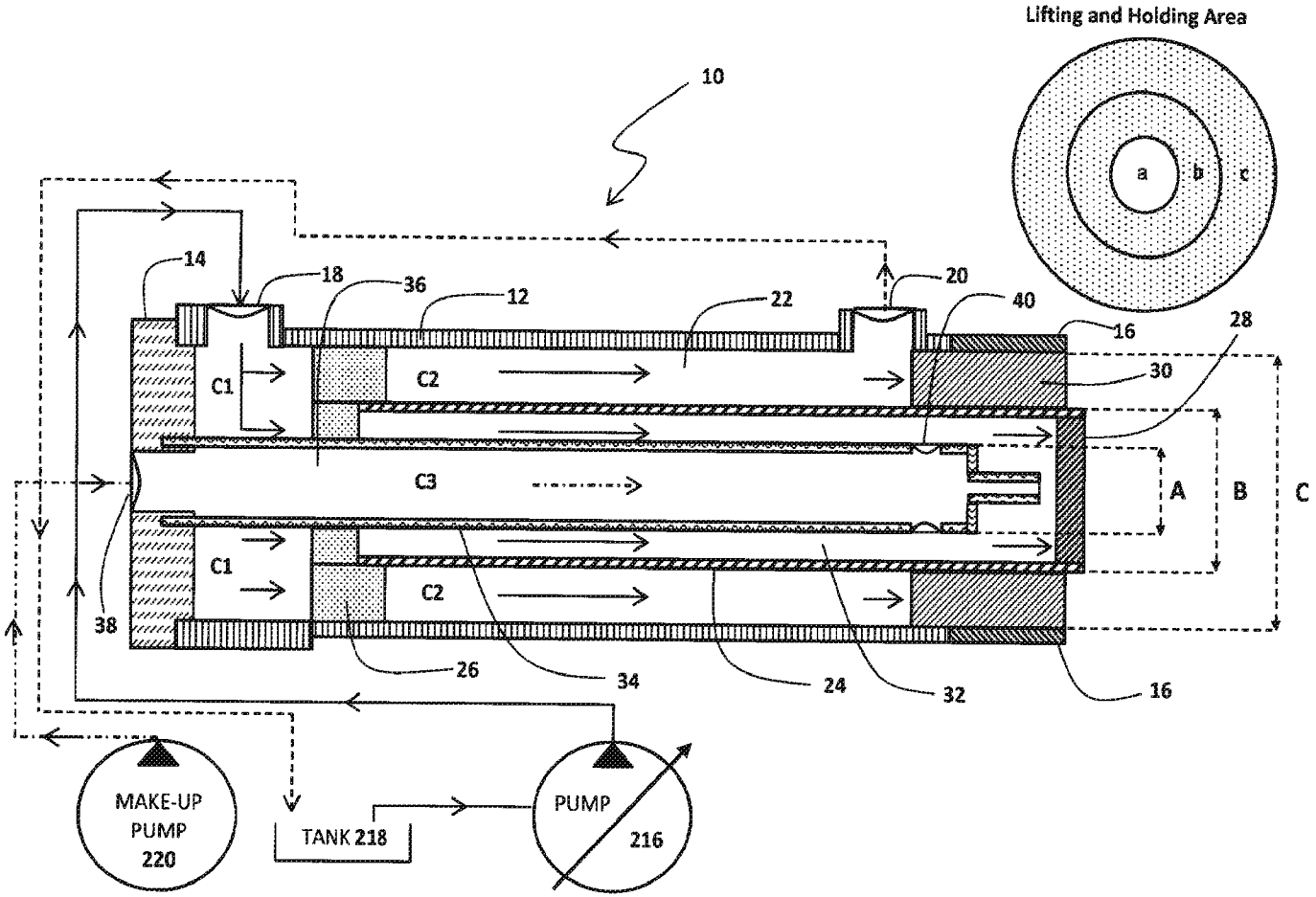

FIG. 4 is a schematic representation of the same MDHC embodiment 10 shown in the retracted position with arrows indicating hydraulic fluid flow through the chambers C1 and C2 for the virtual hoisting gear designated herein as "Hoist 2." The solid arrows indicate fluid movement under direct hydraulic pressure and the dashed arrows indicate the movement of fluid displaced from the MDHC 10.

Figure 5:
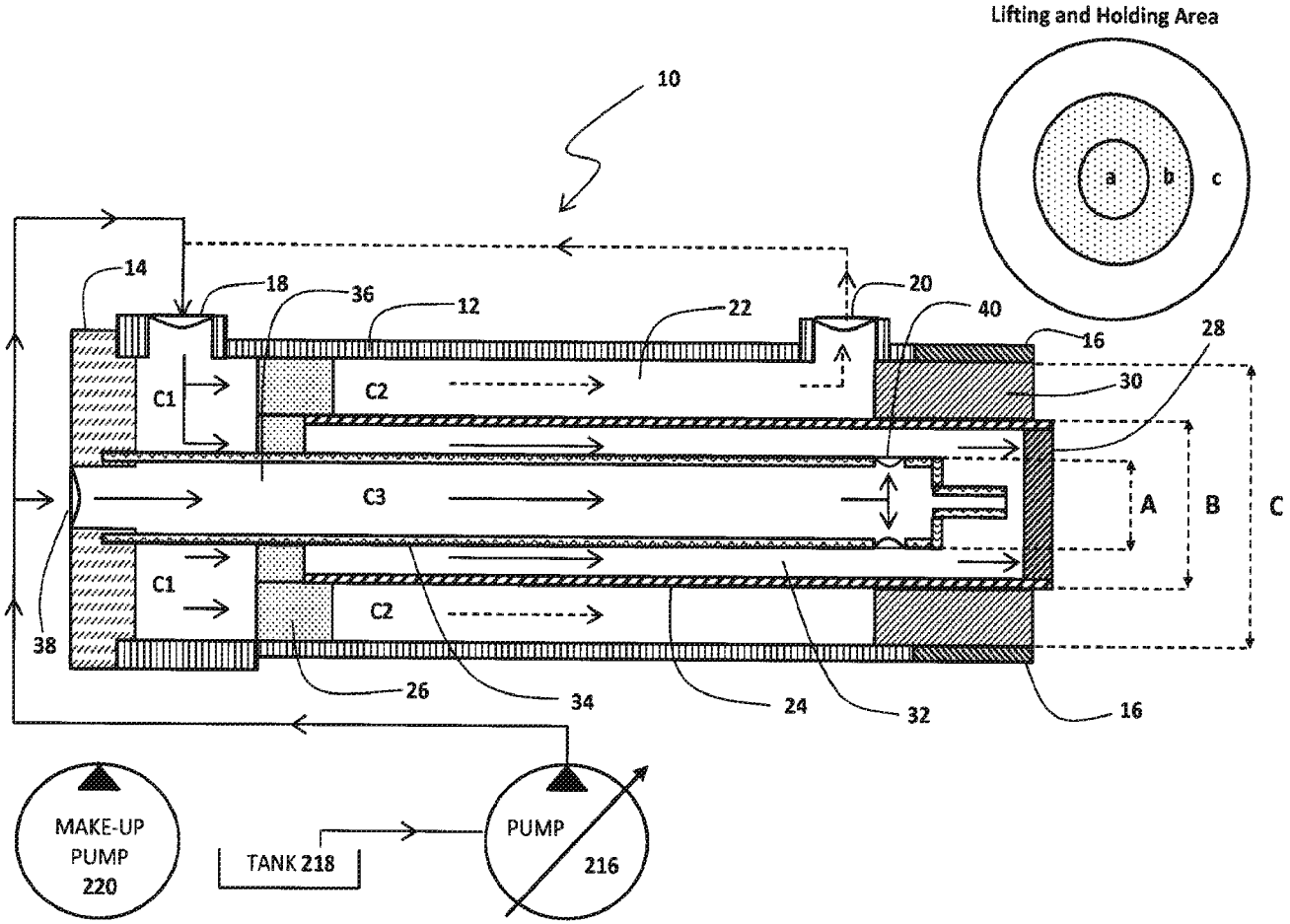

FIG. 5 is a schematic representation of the same MDHC embodiment 10 shown in the retracted position with arrows indicating hydraulic fluid flow through the chambers C1, C2 and C3 for the virtual hoisting gear designated herein as "Hoist 3." The solid arrows indicate fluid movement under direct hydraulic pressure and the dashed arrows indicate the movement of fluid displaced from the MDHC 10.

Figure 6:
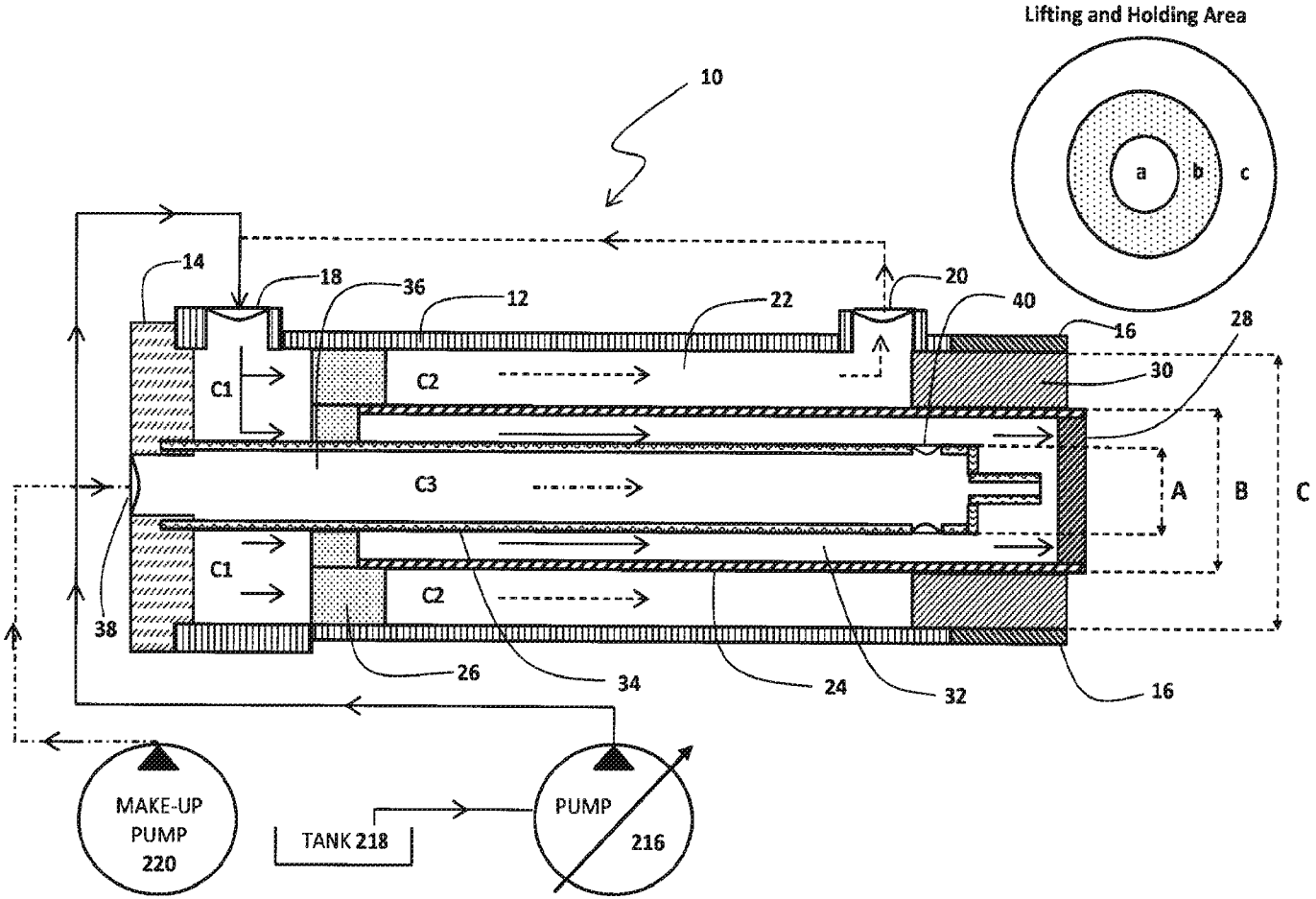

FIG. 6 is a schematic representation of the same MDHC embodiment 10 shown in the retracted position with arrows indicating hydraulic fluid flow through the chambers C1, and C2 for the virtual hoisting gear designated herein as "Hoist 4." The solid arrows indicate fluid movement under direct hydraulic pressure and the dashed arrows indicate the movement of fluid displaced from the MDHC 10.

Figure 7:
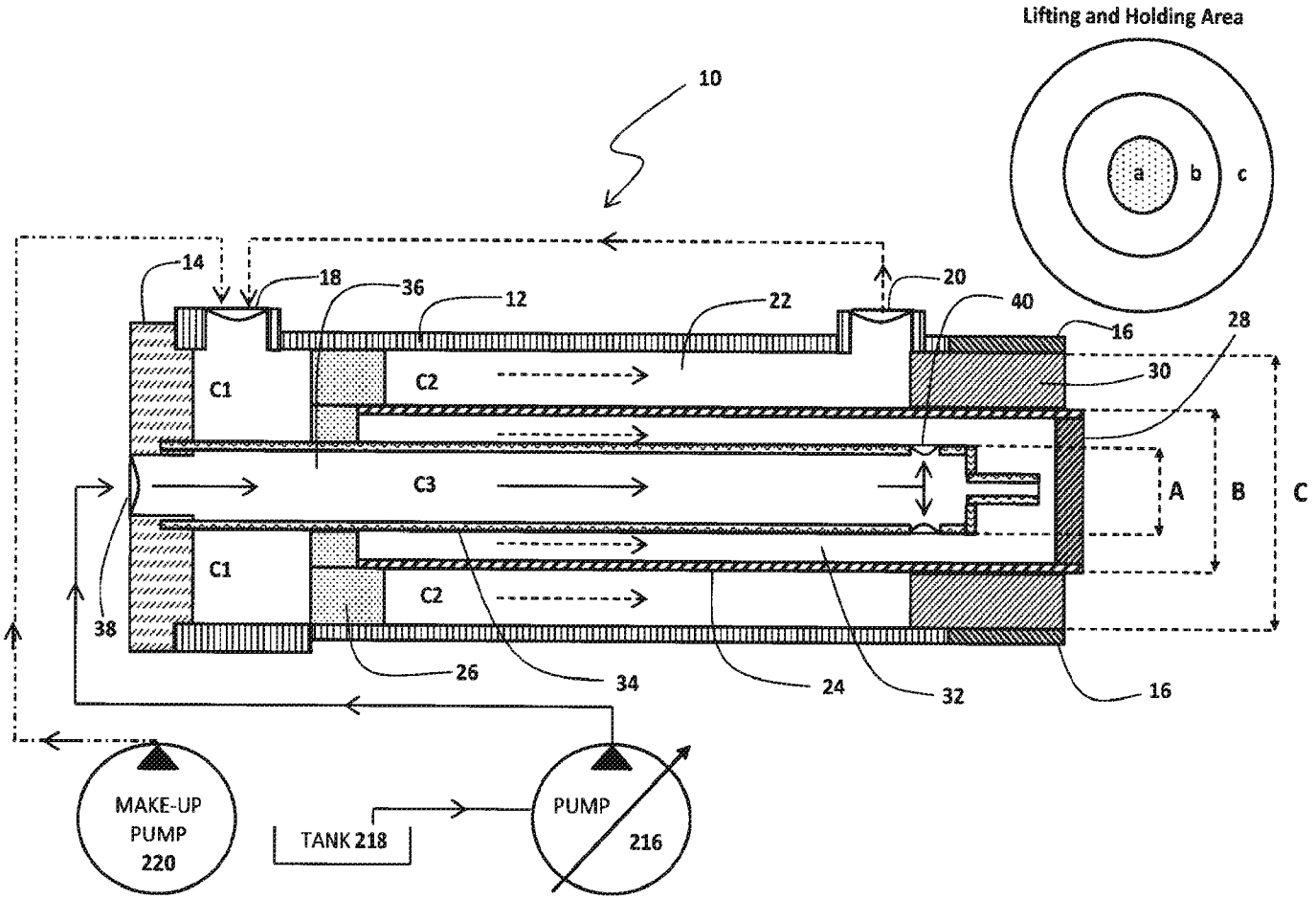

FIG. 7 is a schematic representation of the same MDHC embodiment 10 shown in the retracted position with arrows indicating hydraulic fluid flow through the chambers C1, C2 and C3 for the virtual hoisting gear designated herein as "Hoist 5." The solid arrows indicate fluid movement under direct hydraulic pressure and the dashed arrows indicate the movement of fluid displaced from the MDHC 10.

Figure 8:
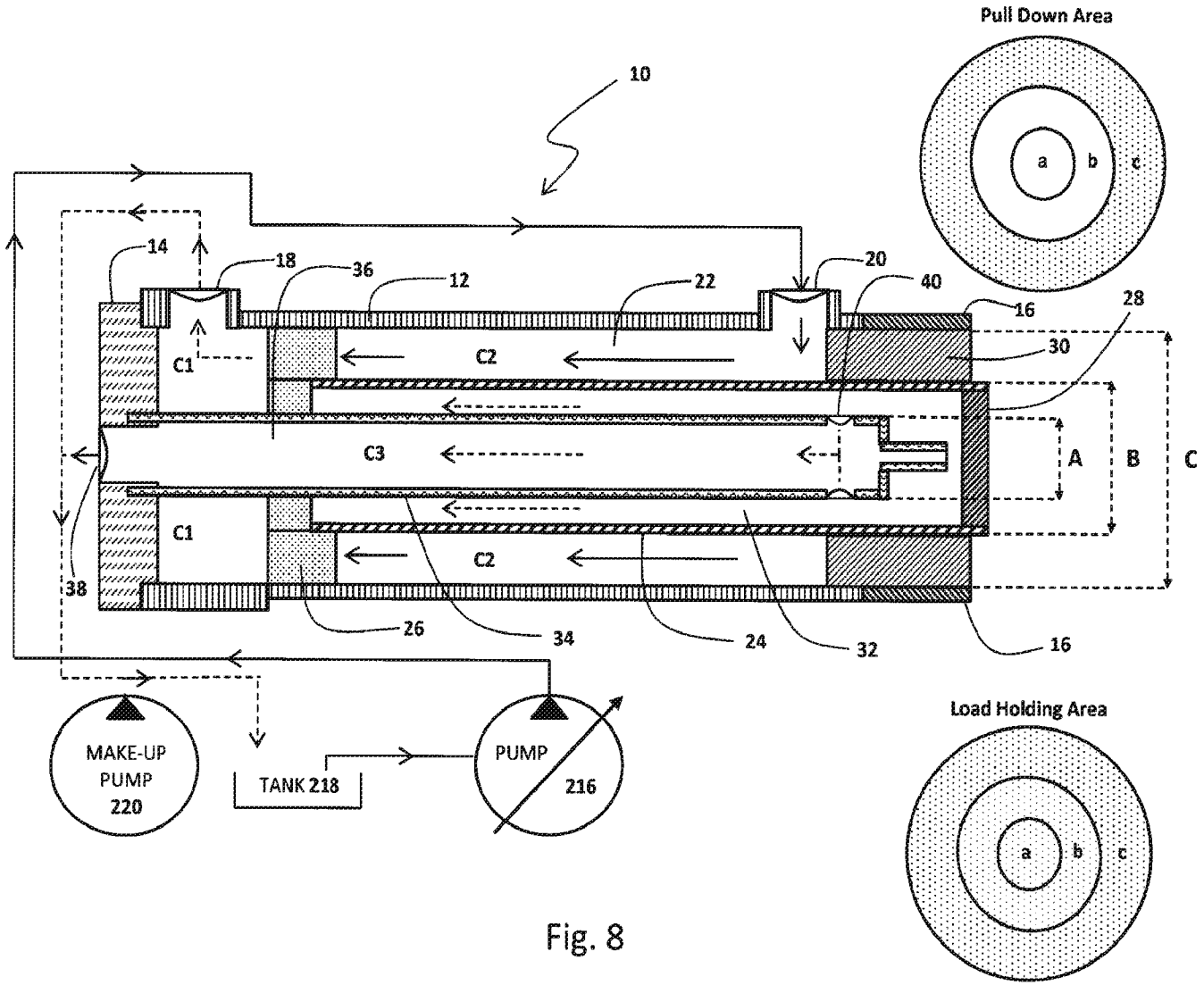

FIG. 8 is a schematic representation of the same MDHC embodiment 10 shown in the retracted position with arrows indicating hydraulic fluid flow through the chambers C1, C2 and C3 for the virtual hoisting gear designated herein as "Lower 1." The solid arrows indicate fluid movement under direct hydraulic pressure and the dashed arrows indicate the movement of fluid displaced from the MDHC 10.

Figure 9:
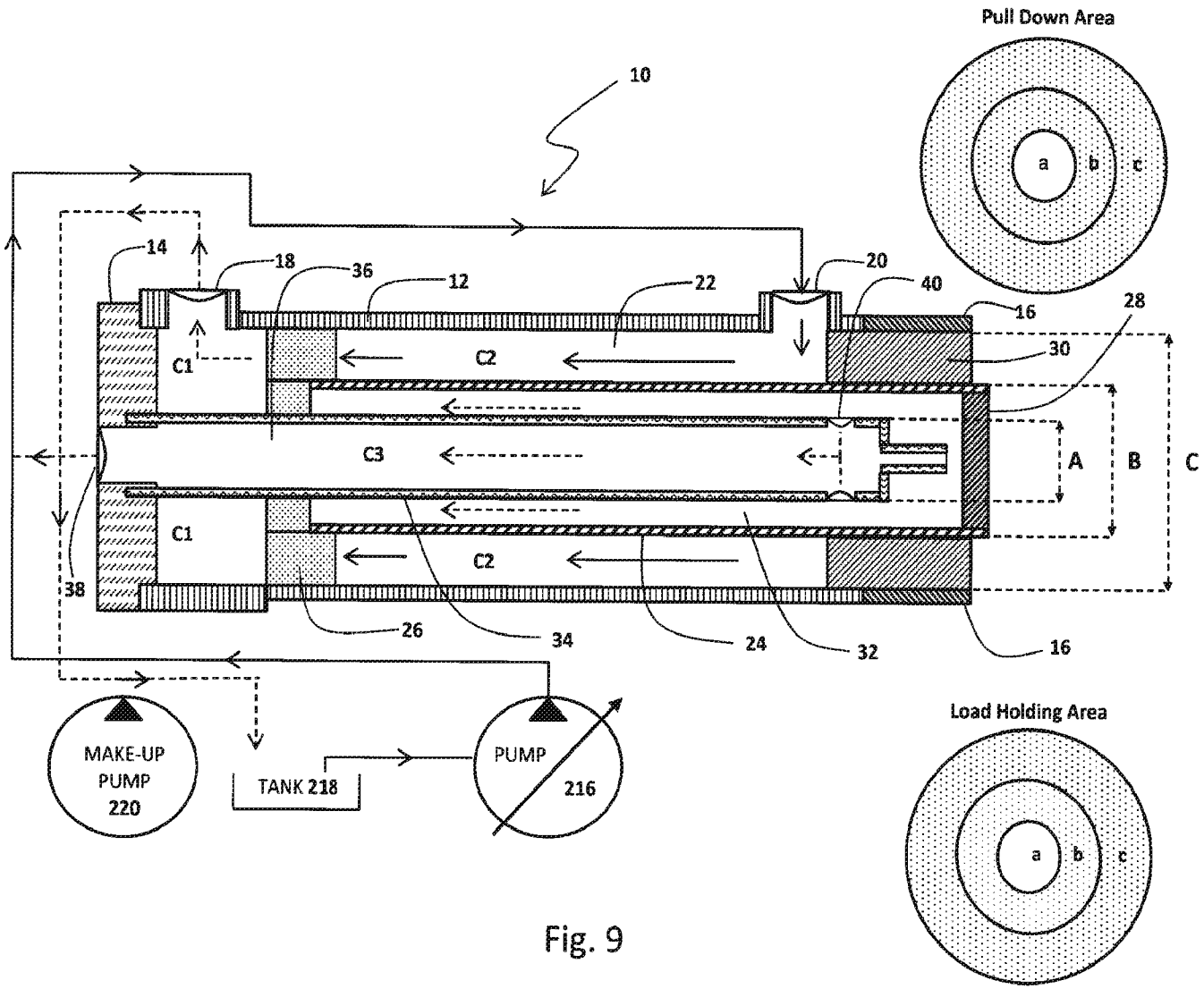

FIG. 9 is a schematic representation of the same MDHC embodiment 10 shown in the retracted position with arrows indicating hydraulic fluid flow through the chambers C1, C2 and C3 for the virtual hoisting gear designated herein as "Lower 2." The solid arrows indicate fluid movement under direct hydraulic pressure and the dashed arrows indicate the movement of fluid displaced from the MDHC 10.

Figure 10:
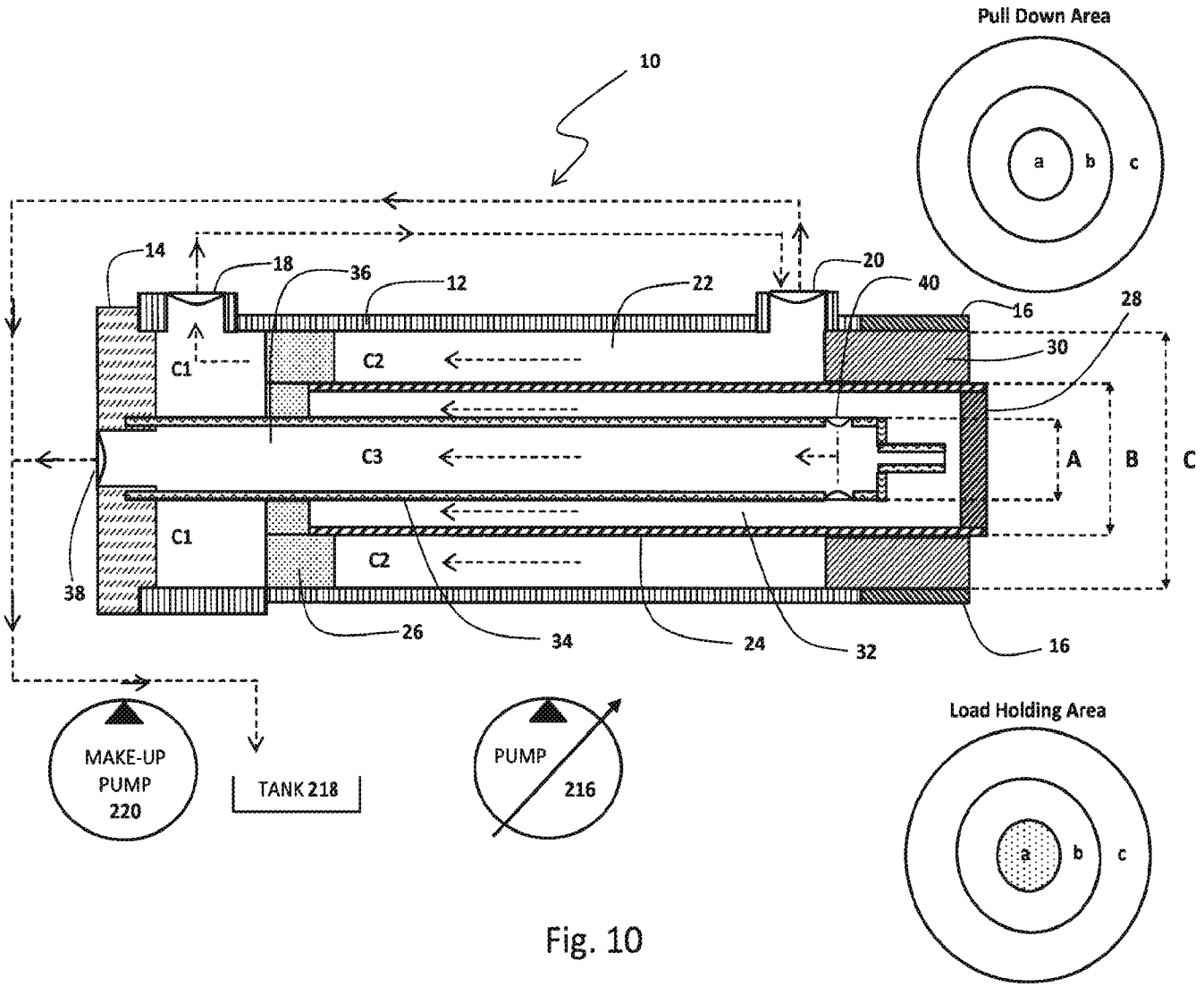

FIG. 10 is a schematic representation of the same MDHC embodiment 10 shown in the retracted position with arrows indicating hydraulic fluid flow through the chambers C1, C2 and C3 for the virtual hoisting gear designated herein as "Lower 3." The solid arrows indicate fluid movement under direct hydraulic pressure and the dashed arrows indicate the movement of fluid displaced from the MDHC 10.

Figure 11:
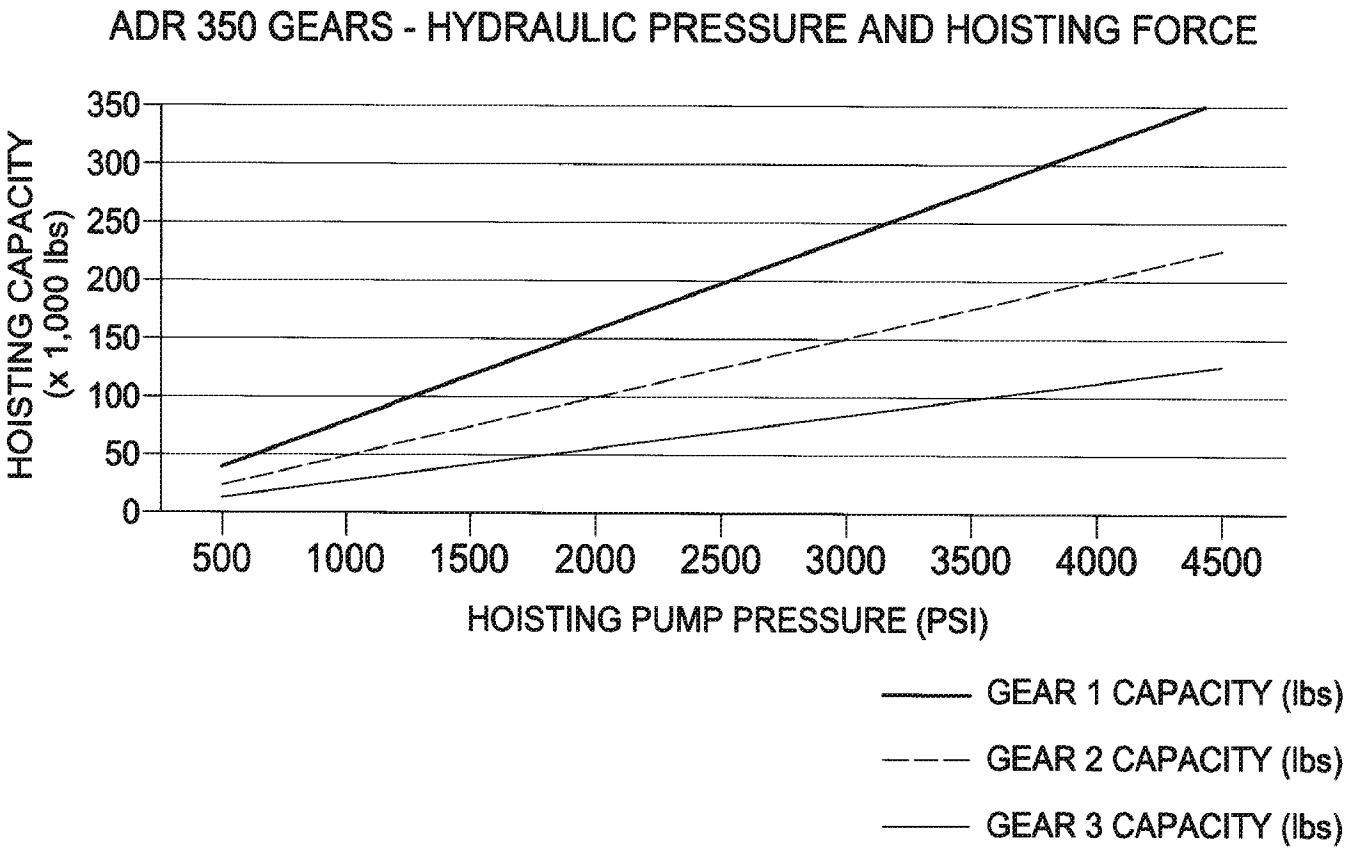

FIG. 11 shows a plot of hoisting capacity vs. hoisting pump pressure for Gears 1, 2 and 3 in accordance with the MDHC assembly embodiment described in Example 1.

Figure 12:
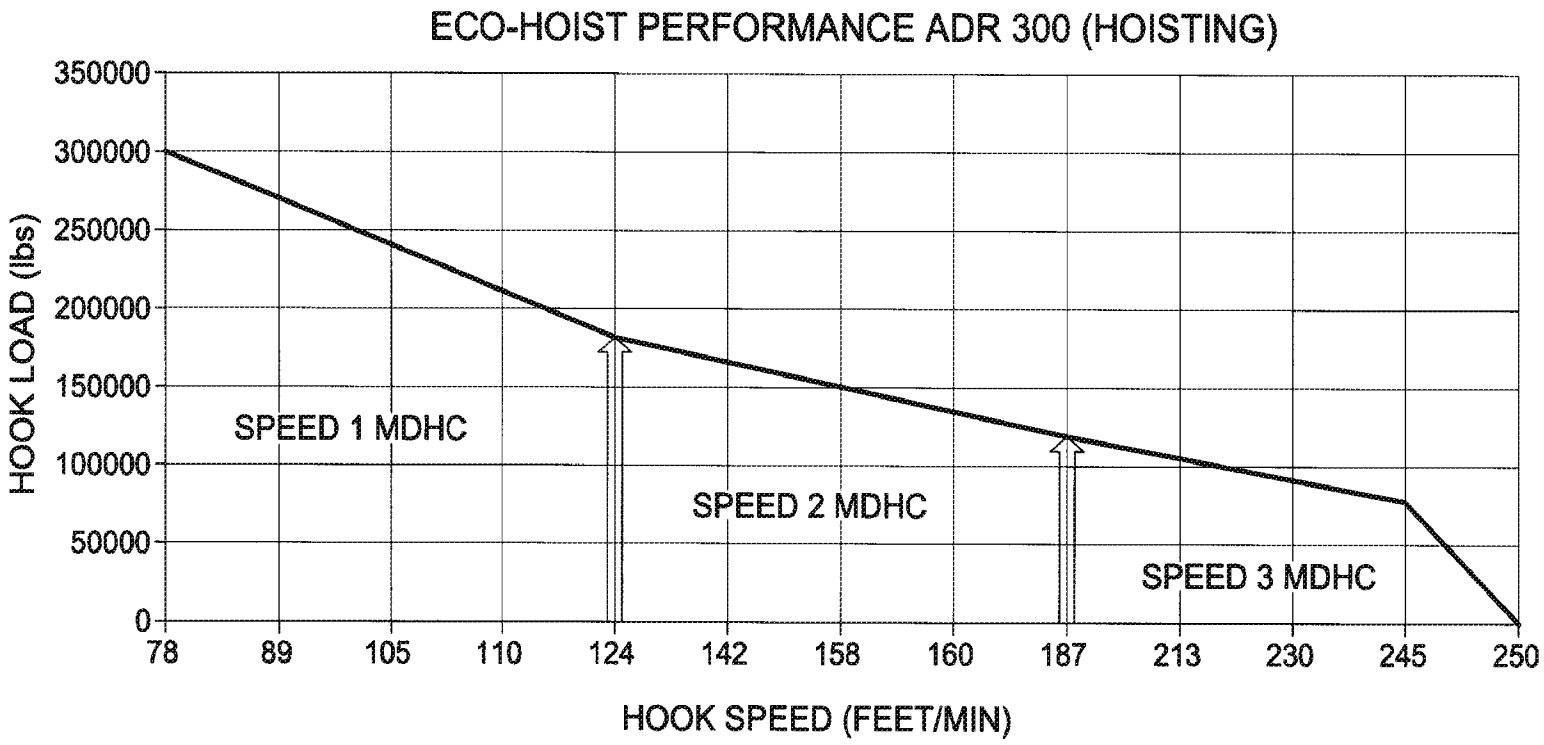

FIG. 12 is a plot indicating the hoisting performance of an Ensign ADR® 300 drilling rig with an MDHC system. The hook speed is indicated as a function of hook load for three different hoisting gears as described in Example 1.

Figure 13:
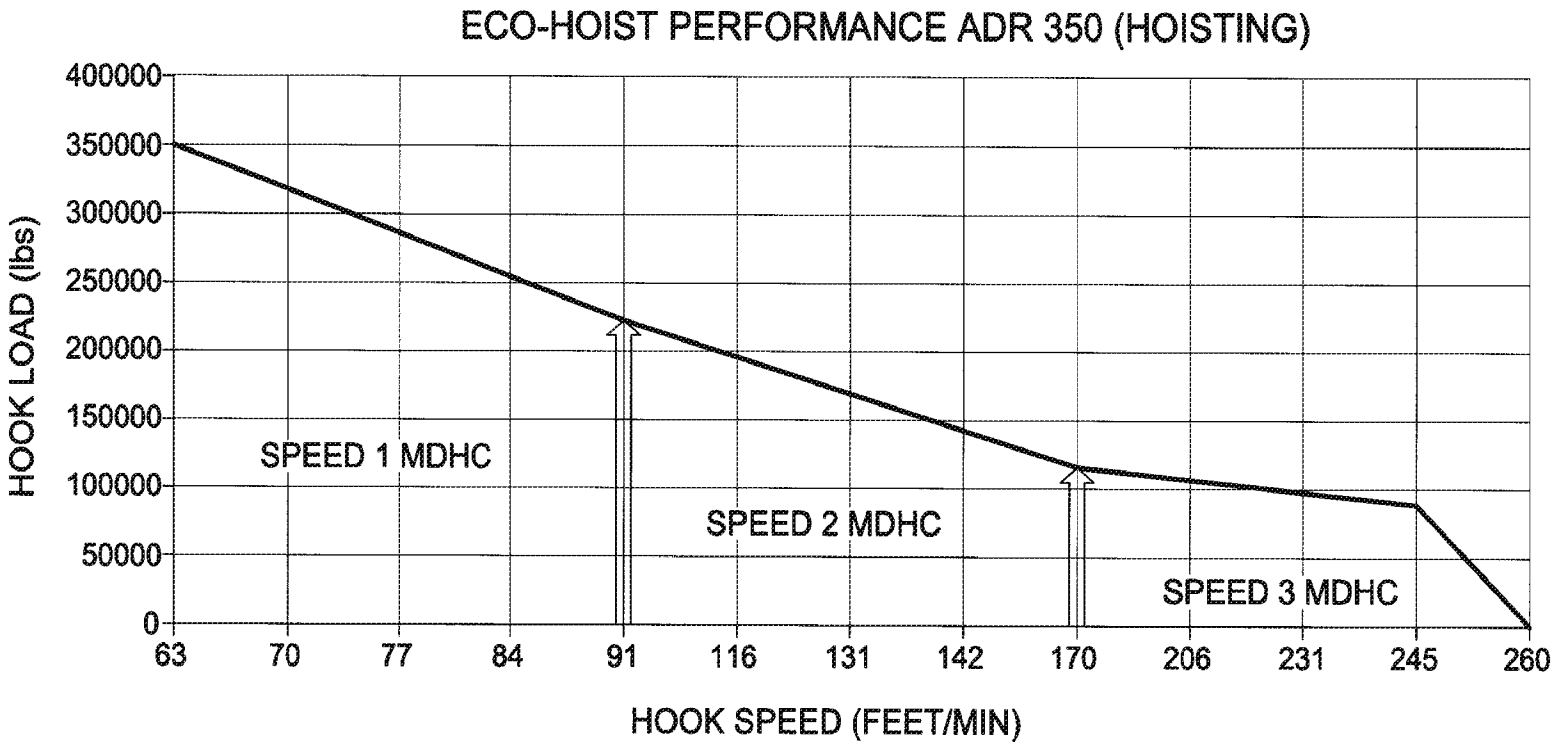

FIG. 13 is a plot indicating the hoisting performance of an Ensign ADR® 350 drilling rig with an MDHC system. The hook speed is indicated as a function of hook load for three different hoisting gears as described in Example 1.

DETAILED DESCRIPTION OF THE INVENTION

Overview

The invention will now be described with reference to FIGS. 1-10, wherein similar reference numerals refer to similar parts throughout. Reference is made to a multi-displacement hoisting cylinder (MDHC) throughout the description. While the name of this component refers to hoisting (i.e. raising) of a drill string in a drilling rig, it is to be understood that the MDHC also provides functions for lowering of a drill string.

Figure 1B:
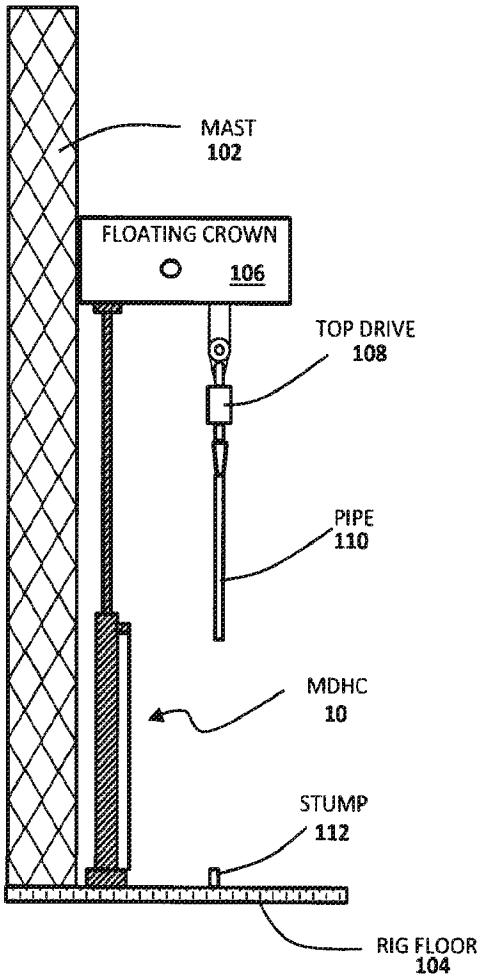
FIG. 1B is a schematic representation of a drilling rig 100 with a multi-displacement hoisting cylinder (MDHC) 10 in the extended position.
Figure 1A:
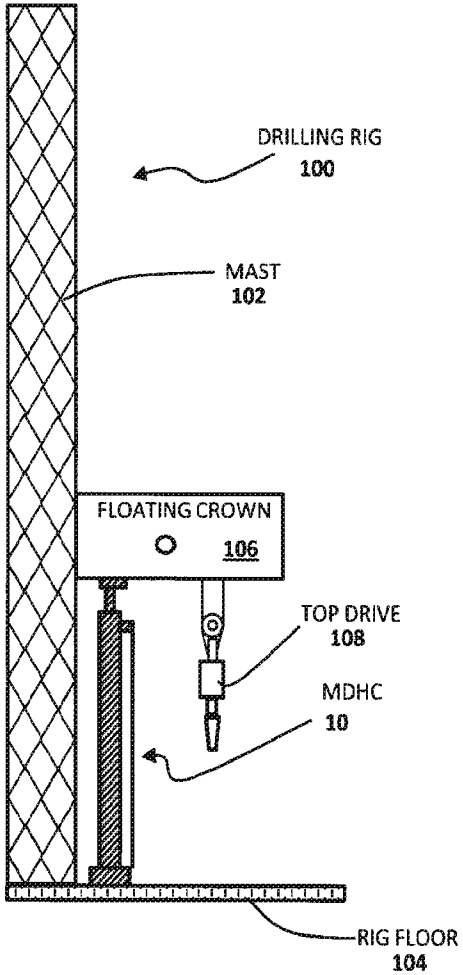
FIG. 1A is a schematic representation of a drilling rig 100 with a multi-displacement hoisting cylinder (MDHC) 10 in the retracted position.

FIGS. 1A and 1B are schematic drawings indicating how the fully retracted MDHC 10 (FIG. 1A) and the fully extended MDHC 10 (FIG. 1B) are arranged within a drilling rig shown generally at 100. The drilling rig 100 includes a mast 102 a floor 104 (from which protrudes the drill stump 112 (FIG. 1B only) and a floating crown 106. A top drive 108 for providing rotary movement of the pipe 110 is suspended from the floating crown 106. The MDHC 10 is coupled to the floating crown 106 and the rig floor 104 in a conventional manner.

The skilled person will recognize from FIGS. 1A and 1B that extension and retraction of the MDHC 10 hoists and lowers the floating crown 106. A hydraulic system provides the force for extending and retracting the MDHC 10. The hydraulic system will be described with reference to FIG. 2. However, a brief overview of the features of MDHC 10 will first be provided to aid in understanding the operation logic of the hydraulic system. A more detailed description of the various pathways for fluid flow through the system in the various virtual gears will be provided hereinbelow.

Features of the MDHC

The MDHC itself and operation thereof is described in more detail in the schematic drawings of FIGS. 3 to 10 where the MDHC 10 is shown in lengthwise cross section in the retracted position. The arrows generally show the movement of hydraulic fluid from the main pump 216, through the MDHC 10 and through the other components of the hydraulic system. As noted in the brief description of the Figures, the solid arrows indicate fluid movement under direct hydraulic pressure and the dashed arrows indicate the movement of fluid displaced from the MDHC 10. For the sake of simplicity in illustrating the structures and operations of the device, various connectors and sealing structures are omitted. The skilled person will recognize the positions where sealing structures will be required and can produce operating embodiments based on the information provided in the present description without undue experimentation.

With reference to any one of FIGS. 3-10, the MDHC (shown generally at 10) includes a barrel 12 with a blind end cap 14 and an opposite end referred to as the rod end 16. The blind end is defined by a blind end port 18 and the rod end is defined by a rod end port 20. Disposed within the interior 22 of the barrel 12 is a hollow piston rod 24. The blind end of the rod 24 has a piston 26 attached thereto. The other end of the rod 24 is fixed to a rod cap 28 which represents the head of the MDHC 10. Attached to the sidewall of the barrel 12 at the rod end 16 is a rod gland 30 which permits slidable movement of the rod 24 out of the rod end 16 of the cylinder 10.

Disposed within the interior 32 of the hollow rod 24 is a central tube 34 with interior space 36. Central tube port 38 allows displaced hydraulic fluid to enter the interior 36 of the central tube 34 for eventual displacement back to the tank or other re-routing as described in detail below. Central tube 34 is provided with ports 40 which permit flow of hydraulic fluid into the interior space 32 of the rod 24. The line segments shown in dashed lines on the right-hand side of each of FIGS. 3 to 10 indicate the diameters of radial areas of the MDHC 10 which are used as surface areas upon which hydraulic fluid exerts force. The diameter indicated by A represents the outer diameter of the central tube 34. The diameter indicated by B represents the outer diameter of the rod 24. The diameter indicated by C represents the inner diameter of the barrel 12.

It will now be understood from the foregoing description that the MDHC 10 includes three substantially isolated chambers which are identified in FIGS. 3-10 by reference indicators C1, C2 and C3. Chamber C1 is shown in FIGS. 3-10 at the blind end of the MDHC 10 and it will be understood that this chamber is filled with hydraulic fluid via the blind end port 18 (as indicated by arrows to the blind end port 18 in FIGS. 3-6). It is to be further understood that chamber C1 will expand in volume when the piston 26 is pushed by the hydraulic fluid towards the rod end 16. Chamber C2 is shown in FIGS. 3-10 as taking up most of the interior space 22 of the barrel 12. However, it is to be understood that as the volume of chamber C1 increases with pumping of hydraulic fluid into the blind end port 18 as described above, the volume of chamber C2 will decrease as the piston 26 and rod 24 are extended toward the rod end 16. The reverse process will occur when hydraulic fluid is pumped into the rod end port 20, (i.e. when the piston 24 is located closer to the rod end 16, C2 will have a smaller volume than C1 but the volume of C2 will increase as the piston 26 moves to the blind end 14 with a concomitant decrease in the volume of C1). Chamber C3 is the interior volume 34 of the central tube 34. Chamber C3 is filled with hydraulic fluid from the central tube port 38. Fluid may also be directed in the opposite direction through the tube 34, as indicated in FIGS. 8 to 10 which illustrate virtual gears for lowering the drill string.

The three chambers C1, C2, and C3, provide three surface areas for hydraulic pressure to work against. The provision of these three surface areas provides useful combinations of fluid flows within the cylinder with different speed-to-force ratios. Thus, the MDHC 10 provides virtual gears that can be selected for various drilling rig hoisting and lowering operations which have various speed and power requirements. A total of five useful virtual gears for hoisting a drill string and a total of three useful virtual gears are available for lowering a drill string. Each one of these virtual gears will be described in detail hereinbelow, after the following description of incorporation of an MDHC assembly into a drilling rig.

An MDHC Assembly Incorporated into a Drilling Rig

Figure 2:
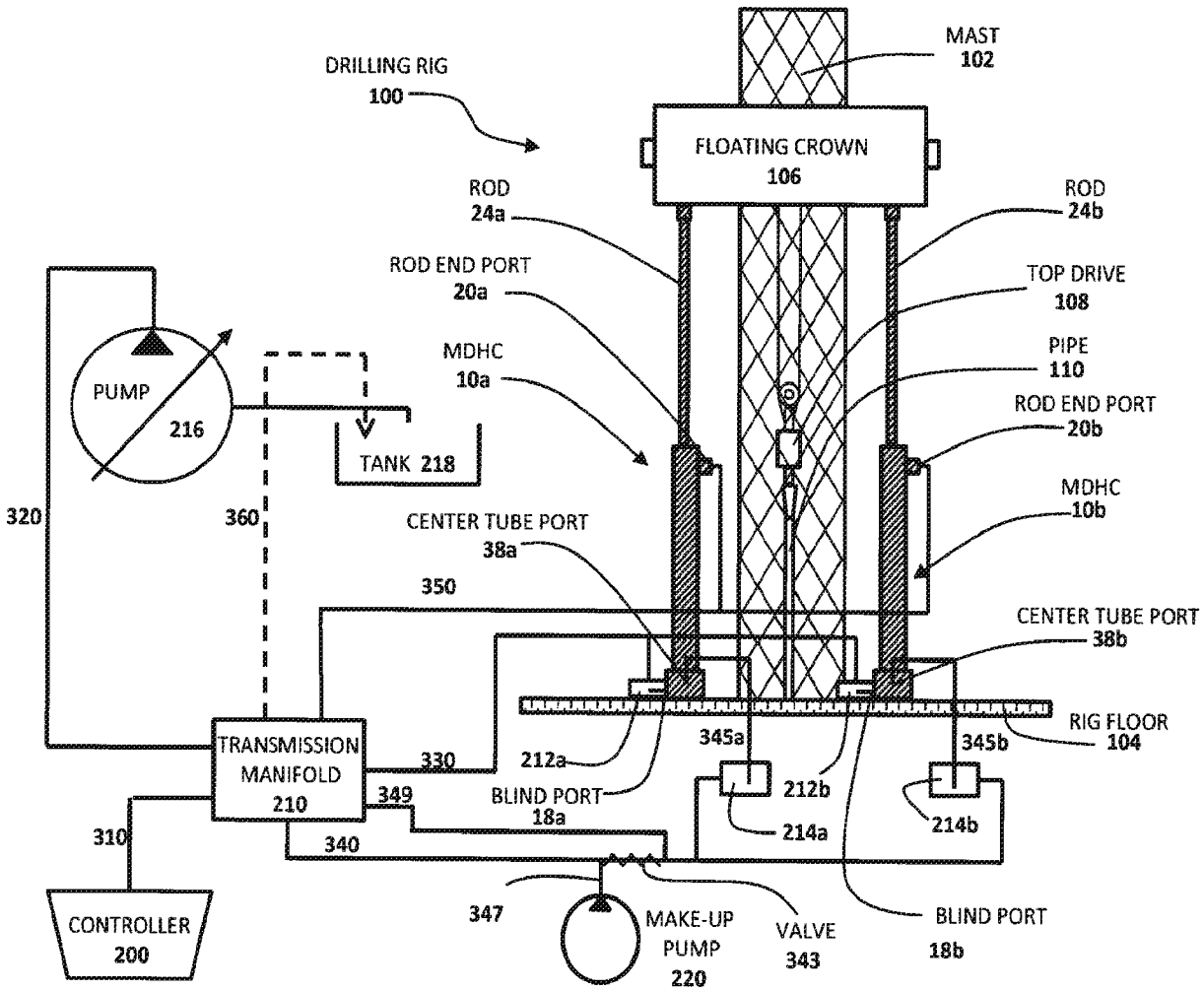
FIG. 2 is a schematic representation of a hydraulic hoisting assembly in association with a drilling rig 100. The hydraulic hoisting assembly includes two MDHC units 10*a* and 10*b*. MDHC components are numbered in the 10 series. The main drilling rig components are numbered in the 100 series. Hydraulic system components are numbered in the 200 series. Hydraulic connections are numbered in the 300 series.

FIG. 2 is a schematic representation intended to illustrate certain features of an example embodiment of an MDHC assembly installed and operating as a drill string hoisting/lowering system on a drilling rig. The drilling rig is shown generally at 100. The components of the drilling rig shown are the mast 102, rig floor 104 and the floating crown (also known in the art as a "travelling crown") 106 which supports the top drive 108 and the pipe of the drill string 110. It is seen that the vertical movement of the floating crown 106 is controlled by two MDHC units shown generally at 10*a* and 10*b*. Indicated on the MDHC units 10*a* and 10*b* are the locations of the blind end ports 18*a* and 18*b*, the center tube ports 38*a* and 38*b* and the rod end ports 20*a* and 20*b*. The rods 24*a* and 24*b* of the MDHC units 10*a* and 10*b* are shown in the extended position. In this position, the floating crown 106 is at its highest vertical level. It is to be understood that retraction of the rods 24*a* and 24*b* into the barrels of their respective MDHC units 10*a* and 10*b* will have the effect of lowering the vertical level of the floating crown 106.

The MDHC units 10*a* and 10*b* are connected to a hydraulic fluid system which may be under manual or automatic control by a controller 200. The controller 200 provides the means for selecting a virtual gear for a hoisting or lowering the drill string 110. The components of the hydraulic system and its connections to the MDHC units 10*a* and 10*b* will now be described in detail.

The lines showing connections between components of the control system and the MDHC units 10*a* and 10*b* include hydraulic transmission lines and/or electronic control conduits to valves residing in the various manifold components which will be described in more detail below. The valves and electronic control conduits used to control the status of the valves are not shown and described in detail. Appropriate configurations of valves and electronic control conduits may be designed by the skilled person without undue experimentation for the various control functions associated with embodiments of the present invention.

It can be seen that controller 200 is in communication with the transmission manifold 210 which itself has hydraulic and electronic connections extending to various components of the system. Among these system components are blind end load holding manifolds 212*a* and 212*b* (connected to the blind end ports 18*a* and 18*b*) and central tube load holding manifolds 214*a* and 214*b* (connected to the central tube ports 38*a* and 38*b*) which are provided to ensure leak-free load holding when the rods 24*a* and 24*b* of the MDHC units 10*a* and 10*b* are extended and stationary. It is seen that the blind end load holding manifolds 212*a* and 212*b* are located directly adjacent to the blind end ports 18*a* and 18*b*. The central tube load holding manifolds 214*a* and 214*b* are connected by hydraulic conduits at a distance from the central tube ports 38*a* and 38*b*. The skilled person will be familiar with the components and functions of load-holding manifolds and will have sufficient knowledge to equip an MDHC assembly according to the present invention with such load-holding manifolds without undue experimentation.

The transmission manifold 210 also has a connection to the main hydraulic pump 216 which draws hydraulic fluid from the reserve tank 218 and provides the principal hydraulic pressure required to drive the extension and retraction of the MDHC units 10*a* and 10*b* for hoisting or lowering the drill string 110. The transmission manifold 210 directs the flow path of pressurized hydraulic fluid to the appropriate port(s) of the MDHC units 10*a* and 10*b* and switches flow paths on the basis of instructions received from the controller 200. Such instructions will include selection of virtual gears for hoisting or lowering the drill string.

The transmission manifold 210 also has a connection to the hydraulic fluid reserve tank 218 and can direct displaced hydraulic fluid back to the reserve tank 218. The displaced hydraulic fluid may originate from any of the chambers of the MDHC units 10*a* and 10*b* and be directed to the transmission manifold 210 from the blind end ports 18*a* and 18*b*, the central tube ports 38*a* and 38*b* or the rod end ports 20*a* and 20*b*, or certain combinations thereof which provide various virtual gears for hoisting and lowering the drill string 110.

Make up pump 220 is connected to the central tube ports 38*a* and 38*b* via the central tube load holding manifolds 38*a* and 38*b*. The purpose of the make up pump 220 is to provide equalizing hydraulic fluid pressure to the central tubes of the MDHC units 10*a* and 10*b* in certain virtual gears when the rods 24*a* and 24*b* are being extended without supplying primary hydraulic fluid force to the central tubes.

The connections between the various system components will now be identified using reference numerals in the 300 series to facilitate a discussion of the various virtual gears that can be obtained with switching of hydraulic fluid pressure to various combinations of cylinder ports. The skilled person will understand that for the sake of clarity, the connection lines of the schematic representation shown in FIG. 2 represent hydraulic fluid conduits combined with electronic communication conduits. The various manifolds described herein are equipped with valves under electronic control of instructions provided by the controller 200 via electronic communication conduits. Electronic instructions originating from the controller 200 are passed from the transmission manifold 210 to the other manifolds along the same connection line as the hydraulic fluid originating from the primary pump 216.

Connection 310 is an electronic communication conduit which provides switching instructions to the transmission manifold 210.

Connection 320 extending from the transmission manifold 210 to the primary pump 216 provides instructions to the primary pump 216 to provide pressurized hydraulic fluid to the transmission manifold 210 where it can be directed to any of the three ports of each of the MDHC units 10*a* and 10*b*.

Connection 330 extends from the transmission manifold 210 to the blind end ports 18*a* and 18*b* via their respective blind end load holding manifolds 212*a* and 212*b*. Transmission manifold 210 sends or receives pumped hydraulic fluid via connection 330 and also communicates instructions originating from the controller 200 to the blind end load holding manifolds 212*a* and 212*b*.

Connection 340 extends from the transmission manifold 210 to the central tube load holding manifolds 214*a* and 214*b*, and then via connections 345*a* and 345*b* to the central tube ports 38*a* and 38*b*. Transmission manifold 210 sends or receives pumped hydraulic fluid via connection 340 and also communicates instructions originating from the controller 200 to the central tube load holding manifolds 214*a* and 214*b*. A branch connection 347 extends from connection 340 to make-up pump 220 whose purpose is to prevent formation of a vacuum in the MDHC units 10*a* and 10*b*. This is accomplished by pumping a secondary supply of hydraulic fluid into the central tubes via the central tube ports 38*a* and 38*b* of the MDHC units 10*a* and 10*b* when the virtual gear being used is a hoisting gear that does not include pumping of hydraulic fluid into the central tubes. Connection 349 extends from the transmission manifold 210 to merge with connection 340 at counter balance valve 343.

Connection 350 extends from the transmission manifold 210 to the rod end ports 20*a* and 20*b*. In certain embodiments, the valves controlling the flow of hydraulic fluid to and from the rod end ports 20*a* and 20*b* are housed in the transmission manifold 210.

Connection 360 extends from the transmission manifold 210 to the hydraulic fluid reserve tank 218. Most of the displacements of the MDHC units 10*a* and 10*b* will result in movement of hydraulic fluid therewithin, which is then routed via one or more of the ports to the transmission manifold 210 and then to the tank 218. One exception is the virtual gear designated "Hoist 3" whose function which will be described below together with the other virtual gears. In this virtual gear, hydraulic fluid displaced from the rod end ports 20*a* and 20*b* is routed via the transmission manifold 210 back to the blind end ports 18*a* and 18*b*.

Table 1 indicates the path of hydraulic fluid movement through the system in different virtual gears. Definitions of the terms used in Table 1 are provided below. The flow of hydraulic fluid through the MDHC 10 in each one of these virtual gears will also be described hereinbelow with reference to FIGS. 3-10.

The term "pressure forward" indicates that hydraulic fluid moves under pressure from the main pump 216 outward from the transmission manifold 210 towards the MDHC 10.

The term "closed" indicates that hydraulic fluid does not flow in the indicated connection.

The term "back to TANK" indicates that displaced fluid is directed from the MDHC 10 to the fluid tank reservoir 218.

The term "link to BLIND" indicates that the displaced fluid is directed back to the blind end port 18.

The term "link to ROD" indicates that the displaced fluid is directed back to the rod end port 20.

The term "make-up forward" indicates that the make-up pump is operating.

When the main pump 216 is operating, connection 320 is "on."

When the main pump 216 is not operating, connection 320 is "off."

When fluid is directed to the tank 218, connection 360 is "open."

When fluid is not directed to the tank 218, connection 360 is "closed."

The term "gravity" (which appears only in connection 350 in the virtual gear designated "Lower 3" indicates that the hydraulic fluid flow moving from the transmission manifold 210 to the rod ports 20*a* and 20*b* is induced by the force of gravity on the traveling crown 106 which pushes down the rods 24*a* and 24*b*. The hydraulic fluid displaced from the blind end ports 18*a* and 18*b* is linked to the rod end ports 20*a* and 20*b* by connection 350 in this virtual gear.

TABLE 1

System Connections of Virtual Gears for Hoisting and Lowering of a Drill String

| Virtual Gear | Shown in FIG. | Connection 320 (PUMP) | Connection 330 (BLIND) | Connection 340 (TUBE) | Connection 350 (ROD) | Connection 360 (TANK) |
|---|---|---|---|---|---|---|
| Hoist 1 | 3 | On | Pressure Forward | Pressure Forward | Back to TANK | Open |
| Hoist 2 | 4 | On | Pressure Forward | Make-up Forward | Back to TANK | Open |
| Hoist 3 | 5 | On | Pressure | Pressure | Link to BLIND | Closed |

TABLE 1-continued

System Connections of Virtual Gears for Hoisting and Lowering of a Drill String

| Virtual Gear | Shown in FIG. | Connection 320 (PUMP) | Connection 330 (BLIND) | Connection 340 (TUBE) | Connection 350 (ROD) | Connection 360 (TANK) |
|---|---|---|---|---|---|---|
| Hoist 4 | 6 | On | Forward Pressure | Forward Make-up | Link to BLIND | Closed |
| Hoist 5 | 7 | On | Forward Make-up | Forward Pressure | Back to BLIND | Closed |
| Lower 1 | 8 | On | Forward Back to TANK | Forward Back to TANK | Pressure Forward | Open |
| Lower 2 | 9 | On | Back to TANK | Link to ROD | Pressure Forward | Open |
| Lower 3 | 10 | Off | Link to ROD | Back to TANK | Gravity & Back to TANK | Open |

Virtual Gears for Hoisting and Lowering a Drill String

A description of the hydraulic fluid flow in each of the virtual gears in the MDHC of one embodiment of the invention will now be provided with reference to FIGS. 3-10, wherein solid lines indicate hydraulic fluid under direct pressure from the pump 216 (FIGS. 3-9) or gravity (FIG. 10 only). The dashed lines indicate fluid displacements within and outside of the MDHC. The dot-dashed lines indicated fluid displaced from the make-up pump 220. FIGS. 3-7 indicate virtual hoisting gears and FIGS. 8-10 indicate virtual lowering gears.

Hoist 1

In the arrangement shown in FIG. 3, hydraulic fluid is pumped into the central tube port 38 and into the blind end port 18 (as indicated by the solid arrows on the left side of the drawing). Fluid displaced from the rod end port 20 is routed back to the hydraulic fluid reserve tank 218 (as indicated by the dashed arrows extending to the left side of the drawing). Hydraulic fluid pressure is directed against all three of the designated surface areas a, b and c within the MDHC 10. Fluid pumped into the central tube 34 works against the radial central portion a. Fluid pumped into the blind end works against the radial outer portion b and also against the piston 26 as the rod 24 is extended. The latter action provides force against area c in the remainder of the interior 22 of the barrel 12, The total surface area upon which force is exerted in this arrangement is therefore a+b+c as indicated by the total shaded area in the inset. This arrangement, designated "Hoist 1" is the slowest virtual hoisting gear and is used for hoisting drill strings with the heaviest hook-loads (total weight of the drill string). For example, this virtual gear would be used for hoisting the longest (and heaviest) drill strings extending essentially at or near the extension limit for the drill rig.

Hoist 2

In the arrangement shown in FIG. 4, hydraulic fluid is pumped only into the blind end port 18 (as indicated by the solid arrow on the left side of the drawing) Hydraulic fluid is not pumped into the central tube port 38 from the main driving pump. Instead, low pressure fluid is forwarded to the central tube port 38 by the make-up pump 220 to prevent the formation of a vacuum within the central tube 34 during extension of the rod 24 (see also FIG. 2 where make-up pump 220 is connected to the central tube ports 38*a* and 38*b* via conduits 345*a* and 345*b*). Thus, because there is no hydraulic fluid pressure provided in the tube 34, the force exerted against area a is negligible. Fluid acts against the remaining radial surface areas b+c as a result of the pumping of fluid into the blind end port 18. Fluid displaced from chamber C2 via the rod end port 20 is routed back to the tank as described above for the "Hoist 1" virtual gear (as indicated by the dashed arrows extending to the left side of the drawing). The present arrangement, designated "Hoist 2" is a mid-range gear for lifting drill strings with intermediate hook-loads.

Hoist 3

In the arrangement shown in FIG. 5, hydraulic fluid is pumped into the central tube port 38 and into the blind end port 18. The rod end port 20 is connected to the input for the blind end port 18 such that fluid moving through the interior space 22 (chamber C2) of the barrel 12 moves directly out of rod end port 20 and back to the blind end 14 (chamber C1) via the blind end port 18. As a result, there is no net hydraulic force exerted upon the piston 26. Hydraulic forces are, however, exerted upon the rod end cap 28 from within the interior 32 of the rod 24 and from within the interior 36 of the central tube 34 (chamber C3). Thus, the surface area upon which hydraulic forces act is represented by shaded radial area a+b shown in the inset. Hydraulic forces do not act upon radial area c because hydraulic force upon the piston 26 in chamber C2 is diverted back to the blind end port 18. This arrangement, designated "Hoist 3" is used for lifting drill strings with lighter hook-loads.

Hoist 4

In the arrangement shown in FIG. 6, hydraulic fluid is pumped into the blind end port 18. Hydraulic fluid is not pumped into the central tube port 38 from the main pump. Instead, low pressure fluid is forwarded to the central tube port 38 by the make-up pump 220 to prevent the formation of a vacuum within the central tube 34 during extension of the rod 24, as described above for Hoist 2. The rod end port 20 is connected to the blind end port 18 such that fluid moving through the interior space 22 of the barrel 12 (chamber C2) moves directly out of the rod end port 20 and back to chamber C1 via the blind end port 18. As a result, there is no net hydraulic force exerted upon the section of the piston 26 which is on the outside of the rod 24. As a result of this arrangement which is known as "Hoist 4," hydraulic forces are only provided against radial area b as shown in the inset.

Hoist 5

In this arrangement, shown in FIG. 7, hydraulic fluid is pumped only into the central tube port 38. This pressure acts against the cylinder cap 28 with a relatively low force and causes extension of the piston rod 24 Low pressure fluid is forwarded to the blind end port 18 by the make-up pump 220 to prevent formation of a vacuum as a result of the extension of the piston rod 24. As a result, no hydraulic forces act on radial areas b and c. Hydraulic forces only act on area a as shown in the inset. This arrangement provides a virtual gear designated "Hoist 5." This virtual hoisting gear would tend to be used only under very light hook-loads.

Lower 1

In this arrangement shown in FIG. 8, which is used to lower the drill string, hydraulic fluid is pumped to the rod end port 20 to push the piston 26 in the opposite direction relative to the piston movements described above. This function has the effect of increasing the volume of chamber C2 and decreasing the volume of chamber C1 Fluid is then displaced via the blind end port 18 and via the central tube port 38 back to the fluid reservoir 218. In this arrangement, the retraction force provides a "pull down" force equivalent to radial surface area c as shown in the upper inset. This arrangement can provide a load-holding area of a+b+c as shown in the lower inset.

Lower 2

In this arrangement, shown in FIG. 9, the fluid flow is identical to the fluid flow described for Lower 1 (FIG. 8) with the exception that fluid displaced from the central tube port 38 is directed back to the rod end port 20 instead of being directed to the reservoir 218. Only the hydraulic fluid displaced from the blind end port 18 is directed to the reservoir 218. This arrangement has the effect of providing an effective pull-down area equivalent to b+c. The load-holding area of this arrangement is a+b+c as shown in the lower inset. The load holding functions are provided by the load holding manifolds described hereinabove, in context of the function of the MDHC assembly (FIG. 2).

Lower 3

In this arrangement, shown in FIG. 10, the pump 216 does not operate. The rod 24 is allowed to retract under the force of gravity acting upon the floating crown 106 of the drilling rig 100 (see FIG. 2). The blind end port 18 is connected to the rod end port 20 and fluid displaced from chamber C1 is routed to chamber C2. Hydraulic fluid displaced from the center tube port 38 is routed to the reservoir 218. Excess hydraulic fluid in chamber C2 flows back from the rod end port 20 to the reservoir. Accordingly, there is no effective pull down force (see upper inset). There is however a load holding force provided in the center tube (chamber C3) if the flow to the reservoir 218 is stopped and maintained. This would be effected by the central tube load holding manifold (see FIG. 2 and associated description hereinabove).

EXAMPLES

Example 1: Conventional Hydraulic Drilling Rigs Modified with an MDHC Assembly This example provides general specifications and an operational/control description for an MDHC assembly according to one embodiment of the present invention wherein the MDHC assembly has been incorporated into two different drilling rig systems (Ensign ADR® 300 and Ensign ADR® 350). The results of speed tests of the assembly in these two different drilling rigs will also be described hereinbelow. Benefits of the modified drilling rigs over their conventional counterparts will also be described.

The MDHC system of the assembly is comprised of two 3-chamber double acting hydraulic cylinders (MDHCs) with a load holding manifold mounted directly to the blind end of each MDHC and also connected to a remotely mounted cylinder tube load holding manifold. A "transmission" manifold located inside the power unit is provided to select the appropriate cylinder chamber to direct the flow of hydraulic fluid under pressure. Additionally the assembly includes two other systems; the electrical control system and the hydraulic power unit (main hydraulic pump) as well as the "make-up" pump and hydraulic fluid supply circuit.

The MDHC assembly minimizes prime mover power requirements and has the advantage of providing a high power to weight ratio with speed adjustability of the hydraulic system, and optimization of horsepower transmission at various speeds in a manner similar to that provided by conventional geared draw-works without the disadvantages of extra weight and large physical footprint.

As noted above, the 3-chambered MDHC system provides a number of combinations of displacements which can reduce the input power and flow requirements. The switching of different combinations of hydraulic fluid displacements provides the same effect as changing the gears of a transmission on a conventional draw-works system.

Although as many as five different virtual gears for hoisting are possible (see FIGS. 3 to 7), the embodiment described in this example is configured to provide three virtual gears for hoisting. These gears are designated as "Gear 1", "Gear 2" and "Gear 3" and with reference to the detailed description and the drawings, respectively correspond to the virtual gears designated Hoist 1 (FIG. 3), Hoist 2 (FIG. 4) and Hoist 4 (FIG. 6). Gears 1-3 of the present embodiment each have different load and speed capabilities. Likewise, as many as three lowering virtual gears are possible (see FIGS. 8-10) but the present embodiment of the MDHC assembly is configured to provide only a single gear for lowering (in addition to the previously existing drill string lowering modes in the Ensign ADR® 300 and Ensign ADR® 350 which will be mentioned briefly but not described in detail). The single virtual lowering gear provided by the MDHC is designated the "Lowering Gear" or "Fast Hoist Down" and corresponds to the virtual gear designated "Lower 1" (FIG. 8) in the detailed description and the Figures. As noted in the detailed description, the selections of these displacements are dictated by the combination of valve conditions controlled within the "transmission" manifold and as a result hydraulic fluid is directed into the various combinations of cylinder chambers.

MDHC Units

The 3-chambered hydraulic cylinder of this embodiment utilizes different areas to obtain three different rates of extension which provide the capability to hoist a drill string at different speed-to weight ratios. A center tube is located inside the hollow cylinder rod and is isolated from the cylinder blind end. The provision of the isolated center tube differentiates the MDHC from conventional double-acting hydraulic cylinders.

In this particular embodiment, two MDHC units are mounted in the torque tube and fixed to floating crown for top drive hoisting and lowering. The geometry of blocks hoisting design incurs a mechanical disadvantage of 2:1. (All hoist force calculations are multiplied by a factor of 2 cylinders and divided by a mechanical disadvantage of 2). Each MDHC has a 10 inch bore, a center tube diameter of 6 inches, a rod diameter of 8.5 inches, and a 27 foot stroke. There is a 2-inch blind end connection on the side of the cylinder barrel at the base of the assembly, a 1.5-inch rod end connection on the side of the cylinder barrel near the top of the assembly, and a 2-inch center tube connection at the rear of the cylinder end cap.

Pilot Operated Load Holding Manifolds

In the present embodiment, pilot operated load holding manifolds are incorporated to ensure leak-free load holding at the center tube port. This manifold is hard-piped remotely from the center tube port and is identical in design to the existing blind end manifolds. This manifold houses the load holding check poppets, port relief poppets, and associated pilot control valves. This assembly provides positive load holding even in the event of hydraulic fluid conduit failure anywhere between this manifold and the hydraulic power unit.

Transmission Manifold

The transmission manifold provides multiple speed and force outputs for hoisting using power originating from the hydraulic power unit while supplying hydraulic fluid to the appropriate cylinder chamber or combination thereof via discrete pilot-controlled, logic poppets.

In general terms, a separate pilot hydraulic fluid supply is used for the discrete poppet switching within the transmission manifold (to provide virtual gear selections) to increase shifting speeds. The transmission may operate without the pilot supply. However, it will be shifting at reduced performance due to slower shifting speeds. A feedback device monitors transmission manifold pilot pressure to ensure proper supply pressure at the discrete control valves.

The transmission manifold is located within the hydraulic power unit and replaces the pair of hoisting directional control manifolds found in existing Ensign ADR® rigs.

In the present embodiment, the drilling mode known as the "holdback/auto-digger mode" included in existing hydraulic hoisting ADR® rigs, is retained in the present control system. All auto-digger components have been incorporated into the MDHC transmission manifold and serve the same function as in the existing hydraulic hoisting ADR® drilling rigs. This mode was originally developed to provide an alternative drilling method to the ADR® "Quick-Drill" mode (also known as "Auto-Driller").

Hydraulic Power Unit

The MDHC hydraulic power unit utilizes pump flow more efficiently than a conventional hydraulic hoisting ADR drilling rig. In this particular embodiment, the MDHC hydraulic power unit uses three Rexroth A11-260 cc remote pilot-operated displacement control pumps for transmission supply for hoisting and lowering operations. The MDHC manifold receives pilot supply hydraulic fluid for logic switching and is supplied by a Rexroth A10-28 cc piston pump. Top drive rotation utilizes two (2) Rexroth A11-260 cc pilot operated displacement control pumps and directional control and is unchanged relative to the conventional ADR drilling rigs. Also unchanged is the rig hydraulics supply pump (Rexroth A11-260 cc) and top drive robotics supply pump (Rexroth A10-28 cc). The skilled person will recognize that other pumps with similar specifications as those described above will be appropriate for use in the present invention.

Center Tube Supply Manifolds

During the process of hoisting using virtual hoisting gears 2 and 3 the cylinder center tube does not receive high pressure pump supply and must be supplied with a positive pressure to prevent formation of a vacuum in the tube chamber. During hoisting using gears 2 and 3, hydraulic fluid is supplied to the central tube at a rate equal to the speed of extension and while lowering, the hydraulic fluid is ported out of the transmission manifold and back to the reserve tank. In this particular embodiment, the center tube supply manifolds are positioned inside the hydraulic power unit and are configured to switch kidney hydraulic fluid from the cooler circuit to the transmission during cylinder extension only. Additionally, a feedback device is used to monitor this "make-up" pressure to ensure proper system operation and to monitor against a vacuum condition.

System Operation—Start-Up

Ambient drilling temperatures below 0° C. (32° F.) require a warm up cycle in order to protect hydraulic components and system operation. Due to high fluid viscosities at low ambient temperature, the MDHC control system cannot be operated at maximum speed until hydraulic fluid temperature reaches 10° C. (50° F.). This ensures that the hydraulic components are operating within their specifications and to aid in functional stability within the switching elements.

System Operation—Hoisting

Two different hoisting modes are provided to the drill operator by means of a four-position selector switch mounted on the operator's control console. The first mode is Manual Gear Selection. This mode provides a manual selector for hoisting gears 1-3. The drill operator will select the appropriate hoisting gear based on the weight of the drill string. If hoist potential is less than the weight of the drill string, the top drive hoist will not lift (no damage to the hydraulic power unit or components will occur). The second mode is Automatic Gear Selection. In this position, the system automatically selects the appropriate gear required based on hook load and sequential events indicated by the MDHC control system.

During either of the two hoisting modes; the fast hoist joystick analog output controls the rate of speed (hydraulic fluid flow) independent of the gear selected by a combination of two controls. In the first control mode, the hoist joystick analog signal controls pump displacement on the pump control manifold. In the second control mode, the hoist joystick analog signal controls proportional throttle valve on the transmission manifold to "meter-in" command flow to the hoisting cylinders.

The gear selector switch and joystick micro-switch sends a discrete signal to the rig PLC which, through logic, energizes the appropriate devices for the gear selected and normal operating state.

System Operation—Hook Load and Tonnage Set Up

During all hoist conditions the drill operator can set the maximum pull capacity of the hoisting system regardless of the selected gear by a hook-load dial with graduated scale (0-350 k). In order to derive the desired set point, the human to machine interface (HMI) initiates a setup process which scales hoisting command pressure to device voltage. The rig PLC calculates hydraulic pressure cut-off at the desired hook load setting and maintains that set point based on the derived scale and gear selected.

System Operation—Hoisting Gears

This section provides a brief description of fluid flow in the hoisting gears of the present embodiment and refers to FIGS. 3, 4, 6 and 8.

Gear 1 (Low Range)—Blind End and Center Tube

With reference to FIG. 3, high pressure hydraulic fluid from the main pump 216 is connected to both the blind end port 18 and the center tube port 38. Hydraulic fluid is displaced from chamber C2 as the rod 24 extends. The displaced hydraulic fluid is routed back to the hydraulic fluid reservoir tank 218 via the rod end port 20 (as indicated by the dashed arrows). The effective lifting area is calculated from the interior diameter of the center barrel 12 to the outer diameter of the center tube 34 plus the outer diameter of the center tube 34 itself, as indicated in the inset of FIG. 3 (corresponding to the entire area a+b+c).

Gear 2 (Mid Range)—Blind End Only

With reference to FIG. 4, high pressure hydraulic fluid from the main pump 216 is routed to the blind end only via the blind end port 18. Hydraulic fluid is displaced from chamber C2 as the rod 24 extends. The displaced hydraulic fluid is routed back to the hydraulic fluid reservoir tank 218 via the rod end port 20 (as indicated by the dashed arrows). Hydraulic fluid pressure from the low pressure make up circuit is connected to the center tube 38 to prevent the formation of a vacuum as the rod 24 extends (not shown in FIG. 4). The effective lifting and holding area is calculated from the interior diameter of the barrel 12 to the outer diameter of the center tube 34, as indicated in the inset of FIG. 4 (corresponding to the area b+c).

Gear 3 (High Range)—Blind End Only with Linkage Between Chambers C1 and C2

With reference to FIG. 6, high pressure hydraulic fluid from the main pump 216 is routed to the blind end only via the blind end port 18. Hydraulic fluid is displaced from chamber C2 via the rod end port 20 as the rod 24 extends. The displaced fluid at rod end port 20 is linked back to the blind end port 18 and combines with the pump flow to extend the rod. Hydraulic fluid pressure from the low pressure make up circuit is connected to the center tube 38 to prevent the formation of a vacuum as the rod 24 extends (not shown in FIG. 6). The effective lifting and holding area is calculated from the outer diameter of the rod 24 to the outer diameter of the center tube 34, as indicted in the inset of FIG. 6 (corresponding to the area b).

System Operation—Hoisting Capacity

FIG. 11 shows a plot of hoisting capacity vs. hoisting pump pressure for Gears 1, 2 and 3.

System Operation—Lowering

When the drill string is to be lowered during tripping/stabbing operations, the MDHC transmission defaults to a single gear referred to as "Lower or alternatively "Fast Hoist Down." When lowering, the fast hoist joystick sends a discrete signal to the programmable logic control to select the appropriate flow path through the transmission. Additionally, the joystick also sends an analog signal to the pump displacement control valves and the transmission throttle valve which will "meter-out" the hydraulic fluid from the blind end.

Lower Gear (Fast Hoist Down)

With reference to FIG. 8, hydraulic fluid under pressure from the main pump 216 is directed to chamber C2 via the rod end port 20 to retract the cylinder. Hydraulic fluid displaced from the blind end port 18 and center tube port 38 during retraction is routed back to the transmission and ported to return to the hydraulic fluid reservoir tank 218. The effective fast hoist lowering area is calculated from the interior diameter of the barrel 12 to the outer diameter of the rod (see area c in the inset) and is force-limited by the programmable logic control to a maximum pressure of approx. 3000 psi at the pump 216. With a maximum command flow of 283 Gal/min, the lowering speed will be 250 feet/min at the maximum allowed pressure of 3000 psi.

Auto-Digger Mode

It is to be understood that in the present example, modification of the existing Ensign ADR 300 and ADR 350 drilling rigs to incorporate the present embodiment of the MDHC assembly retains the original drill string lowering mode known as "auto-digger." The design of the MDHC assembly, and in particular, the transmission manifold, allows this mode to operate generally in its conventional manner. The circuit controlling the auto-digger mode uses a pilot/main stage relief to adjust the pressure differential between the cylinder blind and center tube chambers back to tank. The maximum rate of penetration is dictated by the mechanical stroke limiter on the poppet and while not in use the poppet positively seals the cylinder work ports from the manifold tank port. Specifications provided by the auto-digger mode include a maximum pull-down weight of 20,000 lbs, a maximum hold-back weight of 350,000 lbs, a maximum pull-down pressure of approximately 920 psi and pull-down weight to pressure ratio of 21 lbs/psi.

System Operation—Hoisting and Lowering Pump/Flow Specifications for the ADR 350 MDHC Assembly Table 2 provides specifications for parameters relating to hoisting operations using Gears 1, 2 and 3 as well as the lowering gear. These specifications assume that only a hoist or lowering operation is being performed. Other concurrent functions such as pipe arm operation will reduce the available horsepower for driving these gears. The specifications are based upon an MDHC with a 10 inch bore, 8.5 inch rod and 6 inch center tube with available 800 horsepower at 1800 rpm.

TABLE 2

Speed and Flow for Hoisting Gears 1, 2 and 3 and Lowering Gear

| Working Pressure (psi) | Command Flow (Gal/min) | Approx. Horsepower | Gear 1 Speed (Feet/min) | Gear 2 Speed (Feet/min) | Gear 3 Speed (Feet/min) | Lower Speed (Feet/min) |
|---|---|---|---|---|---|---|
| 500 | 371 | 108 | 91 | 142 | 250 | 250 |
| 1000 | 371 | 216 | 91 | 142 | 250 | 250 |
| 1500 | 371 | 325 | 91 | 142 | 250 | 250 |
| 2000 | 371 | 433 | 91 | 142 | 250 | 250 |
| 2500 | 371 | 541 | 91 | 142 | 250 | 250 |
| 3000 | 371 | 649 | 91 | 142 | 250 | 250 |
| 3500 | 371 | 758 | 91 | 142 | 250 | 250 |
| 4000 | 343 | 800 | 84 | 131 | 231 | 250 |
| 4500 | 305 | 800 | 75 | 117 | 205 | 250 |

Features and Benefits Over Conventional Ensign ADR Range III Hydraulic Single Rigs The modification of Ensign ADR® 300 and 350 drilling rigs with the present embodiment of the MDHC assembly of the present invention provides an increase in hoisting speeds from 160 feet/min to 250 feet/min and an increase in lowering speeds from 150 feet/min to 250 feet/min. This provides a significant increase in overall useable horsepower and allows the modified rigs to achieve corner horsepower at 3 points in drilling/tripping, whereas the conventional rigs achieve 1 point. The modified rigs have a 55% increase in operating performance specifications over the conventional rigs.

Benefits also include a reduction in the number of hydraulic pumps, and components related to oil storage, oil flow and drive. There is a 25% reduction in the number of pumps required (the conventional rigs require a total of four 260 cc hoisting pumps whereas the modified rigs require only three). There is also a 38% reduction in maximum pump flow from 535 Gal/min to 330 Gal/min and a 28% reduction in the number of total pumps required from 7 to 5. Pump drive speeds are reduced from 2000 RPM to 1800 RPM.

This increases available redundancy and increases component life. Furthermore, there is a 50% reduction of pump flow required in the tripping hook load range of 0-100,000 lbs. The oil storage reservoir has been reduced in size by 250 Gallons.

The reduction of the number of pumps from 7 to 5 (and plumbing associated therewith), reduces the pump drive costs and contributes to a 15% reduction in the overall cost of installation of the hydraulic system.

Shown in FIGS. 12 and 13 are performance curves for the MDHC-modified Ensign ADR® 300 and 350 drilling rigs at 800 Horsepower provided by 3 260 cc pumps operating at 1800 RPM (370 GPM). The theoretical values shown may be marginally less due to losses. The curves illustrate performance during manual gear selection. In both cases, the rig is capable of full load lowering at 250 feet/min. When shifting in automatic mode, Gear 1 has capacity for 170,000 to 300,000 lbs; Gear 2 has capacity for 100,000 to 180,000 lbs; and Gear 3 has capacity for 0 to 110,000 lbs. The approximate hoisting usage by load for both rigs is 65% for 0 to 100,000 lbs, 33% for 100,000 to 200,000 lbs and 2% for 200,000 to 300,000 lbs. It is expected that embodiments of the present invention will also be adapted for use with Ensign ADR® 400 and 500 drilling rigs in the near future.

EQUIVALENTS AND SCOPE

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. An assembly for hoisting and lowering a drill string of a drilling rig, the assembly comprising:

a) a multiple displacement hydraulic cylinder having a blind end, a rod end, and a hollow single piston rod having a central tube located therewithin, and a piston connected to the piston rod, the interior space of the cylinder defined by a blind end chamber, a rod end chamber and a central tube chamber, each having a port permitting switchable flow of hydraulic fluid into and out from the cylinder; and b) a pumping and switching system with hydraulic fluid connections connecting a primary pump to each port of the cylinder, the system configured to pump hydraulic fluid and to switch the direction of hydraulic fluid flow through each of the ports of the three chambers, thereby providing the assembly with a plurality of hydraulic fluid flow path combinations, wherein each one of the combinations provides a different speed-to-force ratio for extending or retracting the piston rod, thereby hoisting or lowering the drill string, wherein the pumping and switching system includes a make-up pump for pumping a secondary source of hydraulic fluid into the central tube chamber or into the blind end chamber to prevent formation of a vacuum in fluid path combinations which do not include pumping of hydraulic fluid by the primary pump into the central tube chamber or into the blind end chamber.

2. The assembly of claim 1, wherein one of the hydraulic fluid flow path combinations includes a flow path directly from the rod end port to the blind end port.

3. The assembly of claim 1, wherein the blind end chamber has boundaries defined by at least a portion of the blind end wall of the cylinder, a blind end face of the piston, an interior sidewall of the cylinder and an outer diameter sidewall of the central tube.

4. The assembly of claim 1, wherein the rod end chamber has boundaries defined by a rod end side of the piston rod, an interior sidewall of the cylinder; an outer sidewall of the central tube, and a rod end wall of the cylinder.

5. The assembly of claim 1, wherein the central tube chamber has boundaries defined by a portion of the blind end wall of the cylinder and the sidewall of the central tube.

6. The assembly of claim 1, wherein the port of the blind end chamber is in the sidewall of the cylinder adjacent the blind end, the port of the rod end chamber is in the sidewall of the cylinder adjacent the rod end, and the port of the central tube chamber is in the blind end wall of the cylinder.

7. The assembly of claim 1, wherein the pumping and switching system comprises a transmission manifold with switchable hydraulic fluid connections to the port of the blind end chamber, the port of the rod end chamber and the port of the central tube chamber.

8. The assembly of claim 7, wherein the transmission manifold is controlled using a manual controller or is under automatic control by a programmable processor.

9. The assembly of claim 7, wherein the pumping and switching system comprises a blind end load-holding manifold operably connected to a hydraulic fluid conduit connecting the transmission manifold with the port of the blind end chamber.

10. The assembly of claim 7, wherein the pumping and switching system comprises a central tube load-holding manifold operably connected to a hydraulic fluid conduit connecting the transmission manifold with the port of the central tube chamber.

11. The assembly of claim 1, wherein the plurality of hydraulic fluid flow path combinations comprises a hoisting combination wherein:

a) hydraulic fluid flows from the primary pump into the port of the blind end chamber and into the port of the central tube chamber; and b) hydraulic fluid flows from the port of the rod end chamber to a reservoir.

12. The assembly of claim 1, wherein the plurality of hydraulic fluid flow path combinations comprises a hoisting combination wherein:

a) hydraulic fluid flows from the primary pump into the port of the blind end chamber without hydraulic fluid flowing into the port of the central tube chamber; and b) hydraulic fluid flows from the port of the rod end chamber to a reservoir.

13. The assembly of claim 1, wherein the plurality of hydraulic fluid flow path combinations comprises a hoisting combination wherein:

a) hydraulic fluid flows from the primary pump into the port of the blind end chamber and into the port of the central tube chamber; and b) hydraulic fluid flows from the port of the rod end chamber to the port of the blind end chamber.

14. The assembly of claim 1, wherein the plurality of hydraulic fluid flow path combinations comprises a hoisting combination wherein:

a) hydraulic fluid flows from the primary pump into the port of the blind end chamber;

b) hydraulic fluid flows from the port of the rod end chamber to the port of the blind end chamber; and c) hydraulic fluid flows from a make-up pump into the port of the central tube chamber.

15. The assembly of claim 1, wherein the plurality of hydraulic fluid flow path combinations comprises a hoisting combination wherein:

a) hydraulic fluid flows from the primary pump into the port of the central tube chamber without hydraulic fluid flowing into the port of the blind end chamber;

b) hydraulic fluid flows from the port of the rod end chamber to the port of the blind end chamber; and c) hydraulic fluid flows from a make-up pump to the blind end chamber.

16. The assembly of claim 1, wherein the plurality of hydraulic fluid flow path combinations comprises a lowering combination wherein:

a) hydraulic fluid flows from the primary pump into the port of the rod end chamber;

b) hydraulic fluid flows from the port of the blind end chamber to a reservoir; and c) hydraulic fluid flows from the port of the central tube chamber to the reservoir.

17. The assembly of claim 1, wherein the plurality of hydraulic fluid flow path combinations comprises a lowering combination wherein:

a) hydraulic fluid flows from the primary pump into the port of the rod end chamber;

b) hydraulic fluid flows from the port of the blind end chamber to a reservoir; and c) hydraulic fluid flows from the port of the central tube chamber to the port of the rod end chamber.

18. The assembly of claim 1, wherein the plurality of hydraulic fluid flow path combinations comprises a lowering combination wherein:

a) hydraulic fluid flows induced by the force of gravity from the port of the central tube chamber to a reservoir;

b) hydraulic fluid flows from the port of the blind end chamber to the port of the rod end chamber; and c) hydraulic fluid flows from the port of the rod end chamber to the reservoir.

19. A drilling rig with an assembly for hoisting and lowering a drill string supported by a floating crown on the drilling rig, the assembly comprising the assembly of claim 1.

20. A method for hoisting or lowering a drill string of a drilling rig, the method comprising:

a) providing the drilling rig with an operative assembly as defined in claim 1;

b) identifying a set of parameters for the hoisting or lowering of the drill string; and c) selecting a combination of hydraulic fluid flow paths for extending or retracting the piston rod, thereby providing a speed-to-force ratio for hoisting or lowering the drill string which is matched to the set of parameters.

21. The method of claim 20, wherein the set of parameters includes the desired speed of hoisting or lowering of the drill string and the weight of the drill string.

22. The method of claim 20, wherein steps b) and c) are repeated during different stages of an operation that includes hoisting or lowering of the drill string.

* * * * *